US007827763B2

(12) United States Patent
Brown et al.

(10) Patent No.: US 7,827,763 B2
(45) **Date of Patent: *Nov. 9, 2010**

(54) INSULATED BLOCKING PANELS AND ASSEMBLIES FOR I-JOIST INSTALLATION IN FLOORS AND CEILINGS AND METHODS OF INSTALLING SAME

(75) Inventors: Lawrence Brown, Boise, ID (US); Comer Brown, Eagle, ID (US)

(73) Assignee: Silpro, LLC, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/115,542

(22) Filed: May 5, 2008

(65) Prior Publication Data

US 2008/0302037 A1 Dec. 11, 2008

Related U.S. Application Data

(63) Continuation-in-part of application No. 11/148,125, filed on Jun. 7, 2005, now abandoned, which is a continuation of application No. 10/376,556, filed on Feb. 27, 2003, now Pat. No. 6,901,715.

(60) Provisional application No. 60/916,288, filed on May 5, 2007, provisional application No. 60/360,763, filed on Feb. 27, 2002.

(51) Int. Cl.
*E04C 3/00* (2006.01)

(52) U.S. Cl. ..... 52/838; 52/702; 52/264; 52/289; 52/650.1

(58) Field of Classification Search ..... 52/702, 52/289, 92.3, 656.9, 92.1, 93.1, 832, 252, 52/264, 611, 599, 647, 650.1, 837, 838, 839
See application file for complete search history.

(56) References Cited

U.S. PATENT DOCUMENTS 1,377,891 A 5/1921 Knight (Continued)

FOREIGN PATENT DOCUMENTS

EP 1253256 10/2002

OTHER PUBLICATIONS

Joist Pocket Liner™ brochure with explanation by Applicant's Agent, product shown at trade show in Autumn of 2001.

(Continued)

*Primary Examiner*—Richard E Chilcot, Jr.
*Assistant Examiner*—Chi Q Nguyen
(74) *Attorney, Agent, or Firm*—Pedersen and Co., PLLC; Ken J. Pedersen; Barbara S. Pedersen

(57) ABSTRACT

Apparatus and methods for spacing, securing, and stabilizing I-joists at their ends, and insulating and structural enhancing I-joist assemblies, are provided around the perimeter, or in the interior, of a floor or ceiling where ends of I-joists are located. Insulated blocking panels may comprise an insulating portion that provides a high-R-value and a structural portion which may comprise vertical panel(s) and optional integral support blocks that provide a profiled end surface for extending to the web of the I-joists. Alternatively, insulated blocking panels with flat, vertical end surfaces may be used with field-installed support blocks, or insulated blocking panels with profiled end surfaces may be used without any support blocks. The support blocks or profiled end surfaces of the insulated blocking panels extend to the web of each I-joist, to fill in the space between the I-joists near the I-joist ends, including a substantial amount of the space immediately adjacent the web of each I-joist. The preferred insulated blocking panels, therefore, insulated the outer perimeter of a floor or ceiling and also contribute vertical load carrying capability, and lateral shear and roll-over resistance.

21 Claims, 24 Drawing Sheets

U.S. PATENT DOCUMENTS

| | | | | |
|---|---|---|---|---|
| 2,332,052 | A | | 10/1943 | Brent |
| 2,495,966 | A | | 1/1950 | Haines |
| 2,981,669 | A | | 4/1961 | Brand et al. |
| 3,960,637 | A | | 6/1976 | Ostrow |
| 4,070,845 | A | | 1/1978 | Cody |
| 4,195,462 | A | | 4/1980 | Keller et al. |
| 4,220,419 | A | * | 9/1980 | Hawes ..... 403/189 |
| 4,336,678 | A | | 6/1982 | Peters |
| 4,423,977 | A | | 1/1984 | Gilb |
| 4,514,104 | A | | 4/1985 | Taylor et al. |
| 4,815,242 | A | | 3/1989 | Gilliland |
| 4,815,243 | A | | 3/1989 | Pardo |
| 4,893,961 | A | | 1/1990 | O'Sullivan et al. |
| 4,905,436 | A | * | 3/1990 | Matsuo et al. ..... 52/252 |
| 4,947,612 | A | | 8/1990 | Taylor et al. |
| 5,203,639 | A | | 4/1993 | Femrite |
| 5,285,612 | A | | 2/1994 | Johnson |
| 5,375,381 | A | | 12/1994 | Park et al. |
| 5,930,968 | A | | 8/1999 | Pullam |
| 6,209,282 | B1 | | 4/2001 | Lafrance |
| 6,301,854 | B1 | | 10/2001 | Daudet et al. |
| 6,318,029 | B1 | | 11/2001 | Huppunen |
| 6,497,080 | B1 | | 12/2002 | Malcolm |
| 6,901,715 | B2 | * | 6/2005 | Brown et al. ..... 52/702 |
| 7,124,544 | B2 | * | 10/2006 | Brown et al. ..... 52/264 |
| 2005/0257442 | A1 | | 11/2005 | Brown et al. |

OTHER PUBLICATIONS

Trus Joist™ pamphlet showing building techniques with explanation by Applicant's Agent of Web Stiffener Attachment (p. 7 of pamphlet), Jul. 2001.

Connector Selection Guide by Boise Cascade Timber and Wood Products Division, Jun. 2000.

* cited by examiner

INSULATED BLOCKING PANELS AND ASSEMBLIES FOR I-JOIST INSTALLATION IN FLOORS AND CEILINGS AND METHODS OF INSTALLING SAME

DESCRIPTION

This application claims priority of Provisional Application 60/916,288, filed May 5, 2007, and this application is a continuation-in-part of U.S. Non-Provisional application Ser. No. 11/148,125, filed Jun. 7, 2005 now abandoned , which is a continuation of U.S. Non-Provisional application Ser. No. 10/376,556, filed Feb. 27, 2003 and issued on Jun. 7, 2005 as U.S. Pat. No. 6,901,715, which claims priority of Provisional Application, 60/360,763, filed Feb. 27, 2002, the entire disclosures of which are hereby incorporated by this reference.

BACKGROUND OF THE INVENTION

1. Field of the Invention

The invention relates to improved apparatus and methods for construction of floor joist and ceiling joist systems. More specifically, the invention relates to improved apparatus that may be installed at the ends of I-joists around the perimeter of a floor or ceiling, or at other locations where I-joist ends are secured into the floor or ceiling structure. The invention may comprise systems for spacing and securing of I-joists into floor or ceiling structures either with or without rim boards. The invention may comprise apparatus and methods for providing insulation between the I-joists and against the rim board, concrete, or other structure against or near which the I-joist ends rest.

The invented assemblies may comprise apparatus and methods previously disclosed in U.S. patent application Ser. No. 10/376,556, filed Feb. 27, 2003 and issued on Jun. 7, 2005 at U.S. Pat. No. 6,901,715, and in Continuation application Ser. No. 11/148,125, filed Jun. 7, 2005, by the instant inventors, the entire disclosure of which applications and issued patent is incorporated herein by this reference.

2. Related Art

In conventional floor construction, attempts at insulation are sometimes done by adding insulation pieces to the perimeter of the floor against the inner surface of the rim board between the I-joist ends. Major problems exist when these attempts are made. These problems include trying to fully insulate between I-joists when the insulation pieces are flexible or "floppy" and the sides of the I-joists are an irregular shape created by the flanges and web. This irregular-surface problem is compounded by the fact that the insulating process is done after the floor is installed, forcing the applicator to move materials from above-floor level to the space underneath the floor, and to work in said space and push insulation pieces against the inner surface of the rim board between the I-joists. Consequently, the quality of the installation can be substandard and the insulation value reduced.

Therefore, there is needed an improved insulation system for I-joist assemblies. The present invention fulfills this need, while providing multiple benefits comprising ease and speed of installation and assembly strength and stability, as is discussed in the following disclosure.

SUMMARY OF THE INVENTION

The present invention comprises apparatus and methods for spacing, securing, and/or stabilizing I-joists at their ends, as may be useful around the perimeter, or in the interior, of floor or ceiling assemblies where ends of I-joists are located.

The invention may comprise apparatus and methods for structurally enhancing and insulating said floor or ceiling assemblies. The invention comprises apparatus including one or more insulated blocking panels comprising an insulating portion that has end profiles, or is used with support blocks having profiles, that match the I-shaped side profile of the I-joists between which it is placed.

The preferred insulated blocking panel comprises both an insulating portion and at least one structural portion. The preferred insulation portion is a block or other layer(s) of material(s) that has/have good insulation properties and that face(s) "outward." The preferred structural portion is a vertically-orientated structural panel component facing "inward" generally toward the interior of the floor and ceiling.

The insulating portion may be a block or one or more layers, herein called a "board" for convenience, that is preferably substantially rigid so that handling and placement of the insulated blocking panels is convenient, certain, and consistent. The insulating portion may be selected, for example, from various foams including open and closed cell foams, polystyrenes, polyisocyanurate, polymethanes, soybean-based foams/polymers, synthetic resins and polymers, fibrous materials such as spun fiberglass, cellulose, treated wood fibers, rock-wool, compressed straw or other agricultural or natural products, and/or any other appropriate insulating materials either separately, in combination, in mixtures, in layers, and/or in composite forms. While it is preferred that the insulating portion be substantially rigid, there may also be embodiments that utilize more flexible insulating portions and rely on the structural portion(s) (and especially the preferred vertical structural panel(s) discussed below) to provide the rigidity for said ease, certainty and consistency in handling and installation as well as to provide the rigidity for structural enhancement of the assemblies. Preferably, the preferred insulation material(s) are formed or attached to each other for forming a block, sheet, or panel of such a thickness that it is generally and substantially rigid and has a high R value.

The structural portion preferably comprises one or more vertical structural panels provided on at least an inner, and optionally also an outer, surface of the insulating portion. Optionally, the structural portion may also comprise support blocks that protrude to the I-joist webs and up to be at or slightly above the level of the I-joist top surfaces. Optionally, an additional structural portion, called herein a perimeter panel, may be added to the outer surface of the insulated blocking panel, for forming a portion of a rim (in lieu of a rim board), and/or a top panel may be added to the top surface of the insulation portion, for forming a horizontal structural panel component. Some or all of these structural portions may be located, sized, and shaped to bear vertical load.

The structural portion attached to the foam board may be made of oriented strand board (OSB), laminated veneer lumber (LVL), orientated strand lumber (OSL), hard or soft wood veneers, hardwood or softwood plywood, high density hardboard, fiberboard, solid woods, Medium Density Fiberboard, particleboard, synthetic fibers, formed and/or treated cellulose, wood strands, plastics, composite materials and other structural materials that have the necessary characteristics, either separately, in combination, and/or in composite. The main purpose and function of the structural portion is to provide additional vertical load capacity and lateral support to the I-joist assembly, and therefore the structural portion (including vertical panels, support blocks if present, and any other structural portions of the insulated blocking panel), should be formed of material that is capable of holding vertical load and providing lateral support. While the insulating portion is preferably rigid or substantially rigid and may be made of many different materials, it is not expected that the insulating portion by itself will contribute the desired amount of load bearing capability and/or lateral support. While the structural portion may be made of many different materials and may have some insulating effect, it is not expected that the structural portion by itself will contribute the desired amount of R-value. Therefore, it may be said that the insulating portion is substantially for insulating, and the structural portion is substantially for structural support and shear resistance.

The structural portion (including vertical panels, and support blocks if present, and/or other load-bearing pieces) may be connected to the foam board by construction glues, adhesives, tapes, and/or foams that bond the surfaces, and/or approved lamination processes, at time of manufacture and shipped to the construction site as a single piece. The insulated blocking panel may be pre-formed at the time of manufacture to be the desired size to fit between I-joists, or may be trimmed if necessary at the construction site.

The insulated blocking panel preferably has ends that are each formed to match the side profile of the I-joist. This matching side profile may be formed by the insulating portion and structural portion extending to substantially fill the area near the I-joist web between the I-joist flanges. Thus, the matching side profile may be formed by the preferred insulating portion and the vertical structural panel(s), or by support blocks that are attached to the insulating portion and/or vertical structural panel(s) at the time of manufacture to be an integral portion of the insulated blocking panel, wherein the integral support blocks extend to substantially fill the area near the I-joist web between the I-joist flanges. In either option, the insulated blocking panel (with or without integral support blocks) reaches near to the I-joist web to insulate preferably the entire space between the I-joists, increase vertical loading capabilities, and enhance resistance to lateral shear forces and to roll-over of the I-joists. "Substantially filling" the area near the I-joist web between the I-joist flanges, and "reaching near" to the web, mean, in the preferred embodiments, that the insulation blocking panel extends to contact the web and preferably the outer vertical surfaces of the I-joist flanges, but does not contact the bottom surface of the top flange or the top surface of the bottom flange. This way, the preferred insulated blocking panel is not wedged in between the flanges and vertical load will not stress the flanges and/or break the flanges away from the web.

In other embodiments, the insulated blocking panels according to embodiments of the invention may be used in combination with support blocks that are installed into the floor or ceiling assembly separately from, and prior to, the insulating blocking panels. Such a combination of separate support blocks and insulated blocking panels still serves to increase vertical loading capabilities, and enhance resistance to lateral shear forces and to roll-over of the I-joists.

In some embodiments, the invention comprises connection of I-joists to a rim board with insulated blocking panels provided against the rim board between the I-joists, which rim boards may be conventional rim boards or rim boards with recesses according to embodiments of the inventors' inventions disclosed in their previous patents/applications. Alternatively, embodiments of the invented insulated blocking panels may be used without any rim board at the ends of the I-joists, in which case the I-joists and the insulated blocking panels may be visible from outside the assembly. In other embodiments, the invention comprises connection of insulated blocking panels to I-joists, wherein each insulated blocking panel has an outer structural panel (herein called a "perimeter panel") than extends outside and along the ends of the I-joists to cover the I-joist ends, in lieu of a rim board. In such embodiments, the outer structural panels preferably extend far enough to meet and, thus, form a nearly continuous perimeter at the end of the I-joists in lieu of a conventional or recessed rim board. In still other embodiments, I-joist ends are located adjacent to a concrete foundation wall rather than adjacent to a rim board, and embodiments of the invented insulated blocking panels are provided between the I-joists at or near the concrete foundation wall.

The insulated blocking panels of the preferred embodiments add insulation value to the perimeter of a building, by filling all or nearly all of the space between the I-joists, or, in cases using separately-installed support blocks, by filling all or nearly all of the space between the support blocks, with a high R insulating material. The insulated blocking panels, especially when combined with the other preferred components of the invented system, provide a tighter, more form-fitting assembly that is easily-installed, more "green," and that features superior load distribution.

BRIEF DESCRIPTION OF THE DRAWINGS

FIG. 1A is perspective view of one, but not the only, embodiment of the invented insulated blocking panel, which comprises an insulation portion that may be called a "foam board," a structural portion that is a vertical structural panel attached to an inner surface of the foam board, and two integral support blocks attached to the two end surfaces of the foam board.

FIG. 1B is another embodiment of the invented insulated blocking panel, wherein the foam board top surface is lowered/recessed relative to its plane in FIG. 1A, to provide room for a top structural panel, so that the upper surface of the top structural panel in FIG. 1B may be on the same plane as the upper surface of the foam block in FIG. 1A. The blocking panel in FIG. 1B comprises both inner and outer vertical structural panels, that is, on each of the inner and outer surfaces of the foam board, and comprises integral support blocks on each end. The top structural panel is added to the top of the foam block and attached by adhesive or other fastening means, for the purpose of providing a nailing surface for edge nailing of the floor sheathing.

Figure 1A:
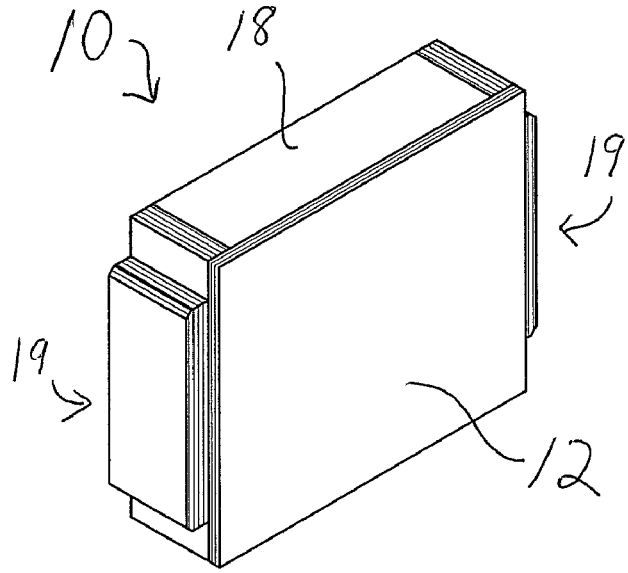
FIGS. 1A and 1B may be considered "inner" perspective views of two, but not the only, embodiments of the invented insulated blocking panel, wherein the side being viewed is the side that generally will be facing the inside of the floor or ceiling assembly.
Figure 1B:
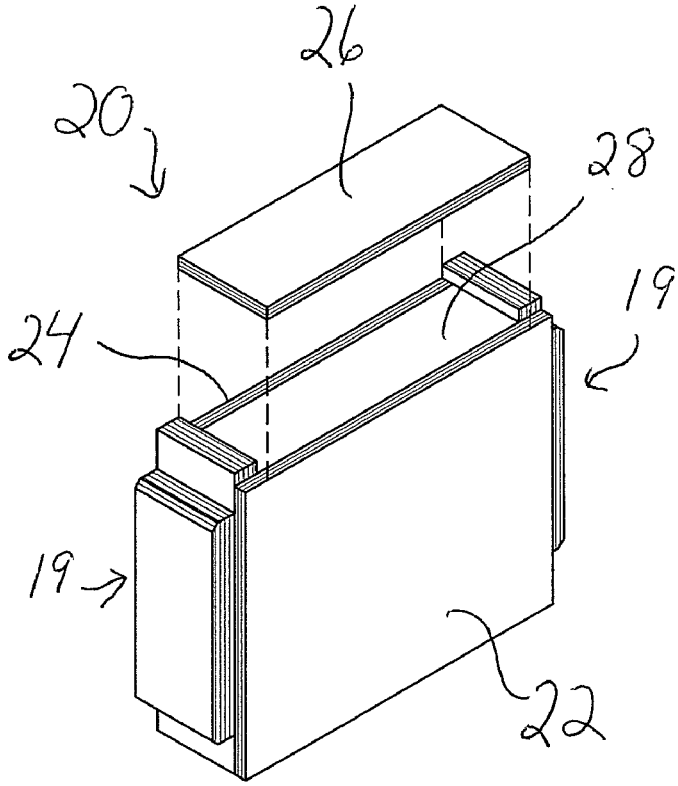

The inner vertical structural panels in the embodiments of FIGS. 1A and 1B are lapped outside of the support blocks, extending along a portion of the support blocks to an extent that, when the insulated blocking panel is installed, the vertical structural panel(s) will reach to the side surfaces of the I-joist flanges. The outer vertical structural support panel in FIG. 1B, however, is preferably not lapped outside the support blocks.

Figure 2A:
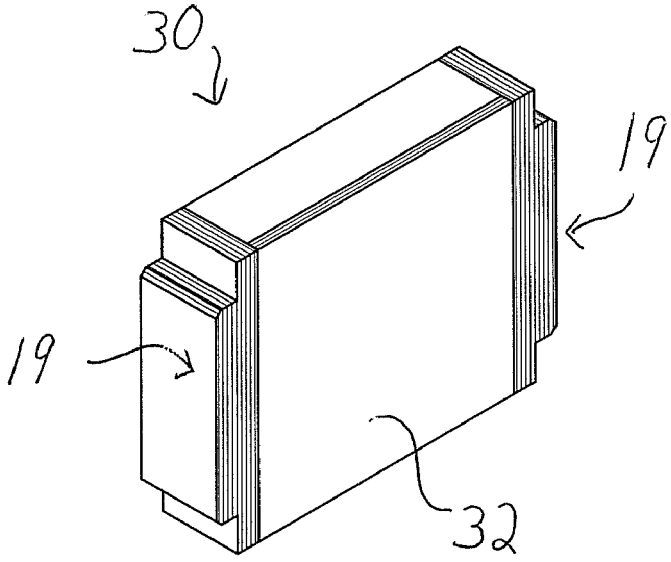

FIG. 2A is a perspective view of an additional alternative embodiment of the invented insulated blocking panel with integral support blocks, wherein the inner vertical structural panel is sized the same as the inner surface of the foam board.

Figure 2B:
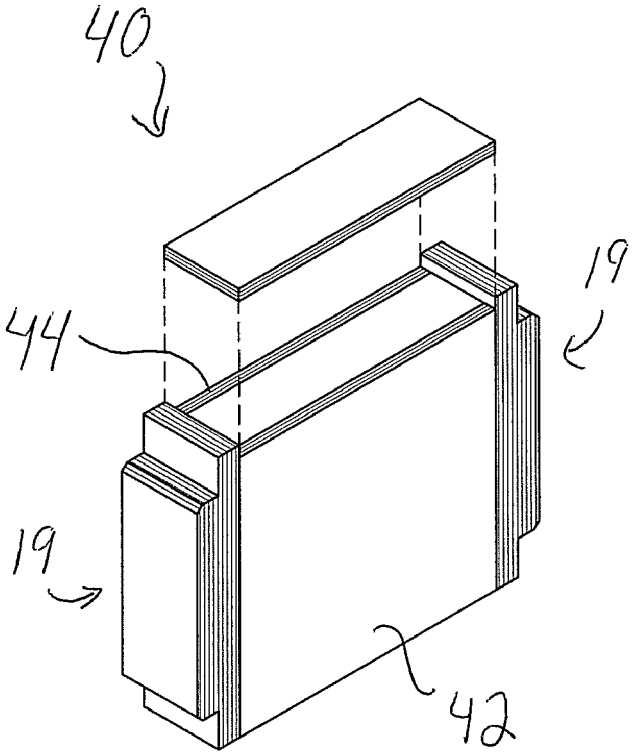

FIG. 2B is yet another alternative embodiment of the invented insulated blocking panel with integral support blocks, comprising inner and outer vertical structural panels sized to be the same as the inner and outer surfaces of the foam board. In FIG. 2B, the foam board and the structural panels are all lowered/recessed to provide room for a top structural panel in between the support blocks. This way, the upper surface of the top structural panel in FIG. 1B may be on the same plane as the upper surface of the foam block in FIG. 1A.

Figure 3:
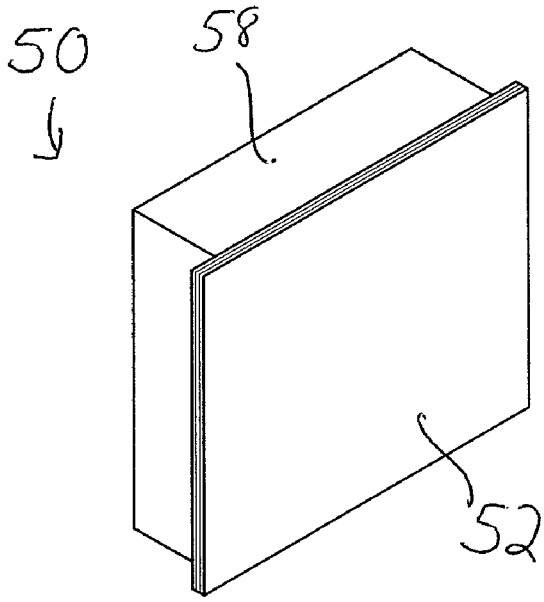

FIG. 3 is yet another embodiment of the invented insulated blocking panel, which does not have integral support blocks. Thus, the insulated blocking panel comprises only a foam board and a vertical structural panel on the inner side of the foam board. The vertical structural panel extends beyond the end surfaces of the foam board for providing some overlap along a portion of separate support blocks that may be installed in the floor/ceiling assembly prior to installation of the insulated blocking panel. The overlap may be sized so that, when the insulated blocking panel is installed, the vertical structural panel extends to the sides surfaces of the I-joist flanges.

Figure 4:
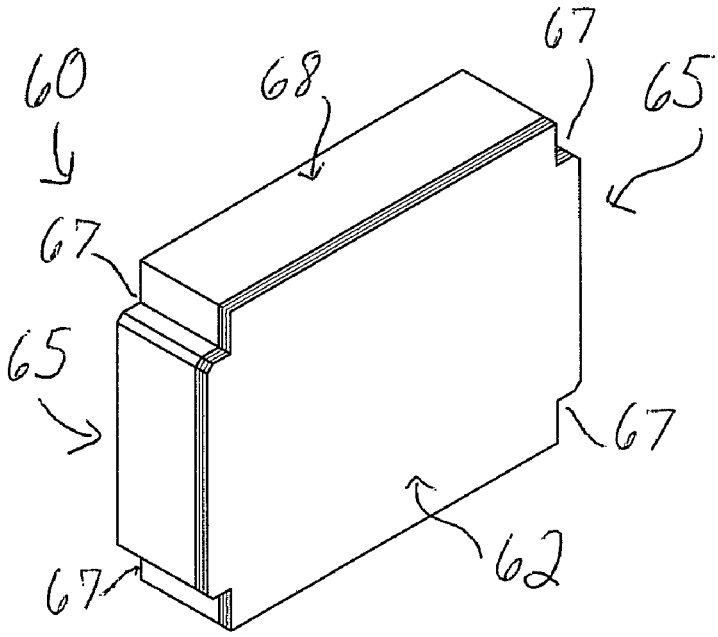

FIG. 4 is yet another embodiment of the invented insulated blocking panel, which, like that in FIG. 3, does not comprise integral support blocks, but is not intended to be used with any support blocks. Extension portions of the insulated blocking panel extend to preferably contact the web of the I-joists on each end of the insulated blocking panel, and to substantially fill the space between the flanges of each I-joist. As with the preferred support blocks invented by the present inventors, it is desired that said extension portions, while being received between the top and bottom flange of the I-joist, do not contact the top and bottom flanges. This helps prevent damage to the I-joist by preventing undesirable forces that might damage the flange-web connection. It may be noted that the extension portions preferably consist of the foam board and inner vertical structural panel extending out from the main (preferably rectangular) body of the insulated blocking panel and that there are preferably no seams, connections, or fasteners between the extensions and said main body. Thus, the preferred extensions are the same materials as the main body.

Figure 5A:
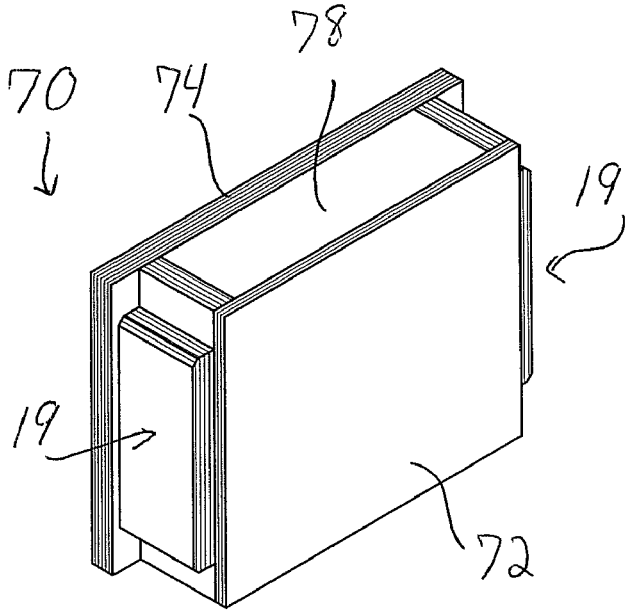

FIG. 5A illustrates yet another alternative embodiment of the invented insulated blocking panel, similar to that of FIG. 1A. This embodiment has an additional vertical structural panel (herein called a "perimeter panel"), on the outer side of the foam board. The perimeter panel may cooperate with perimeter panels of other insulated blocking panels to form a multi-portion perimeter in place of a rim board. The perimeter panel has ends that both extend beyond the foam board slightly out beyond the support blocks, for centering on the I-joists to meet the perimeter panels of adjacent blocking panels.

Figure 5B:
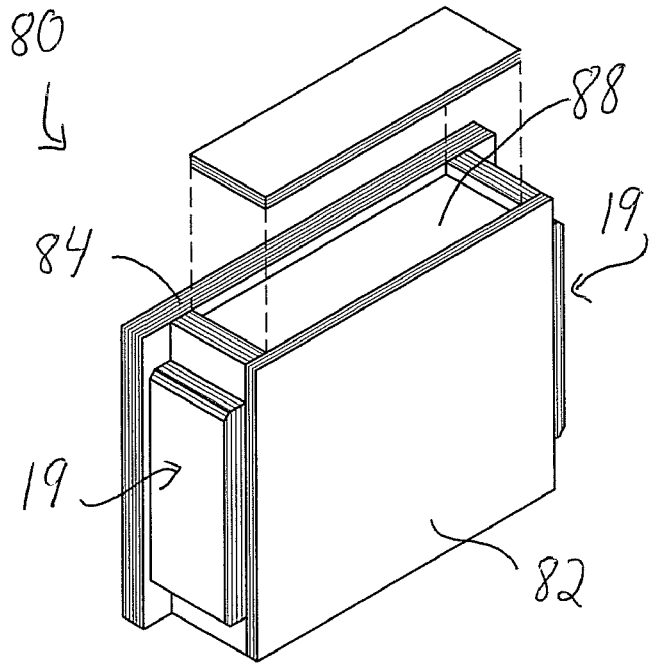

FIG. 5B illustrates yet another alternative embodiment of the invented insulated blocking panel, which is similar to that in FIG. 5A with the addition of a top panel.

FIG. 6-13 are views from the present inventors' U.S. Pat. No. 6,901,715 and patent application Ser. No. 11/148,125, of which this application is a continuation-in-part.

Figure 6:
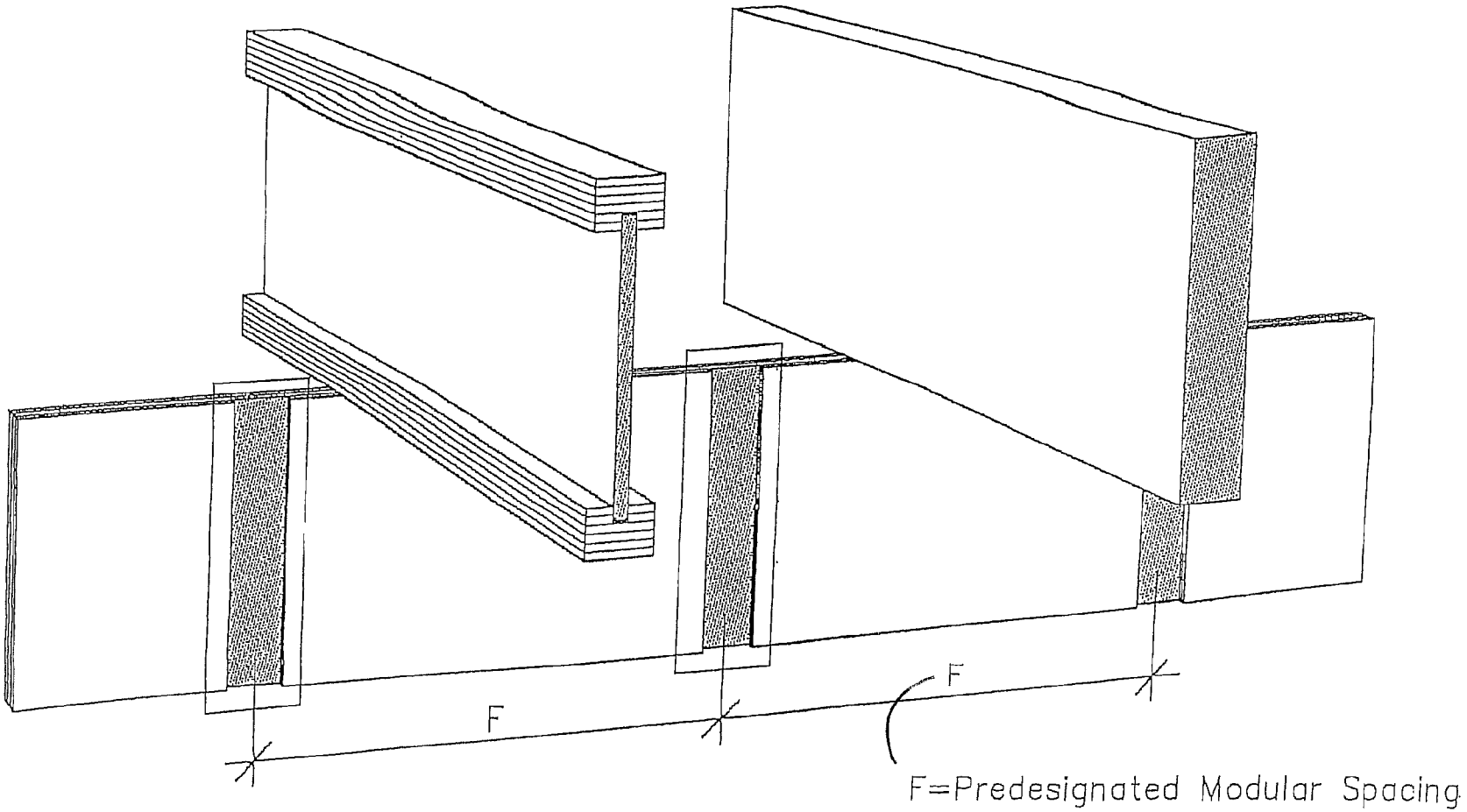

FIG. 6 portrays one embodiment of a rectangular joist and an I-joist being installed in the rectangular recesses of a rim board, in one embodiment wherein an insulated blocking panel according to the invention may be installed.

Figure 7:
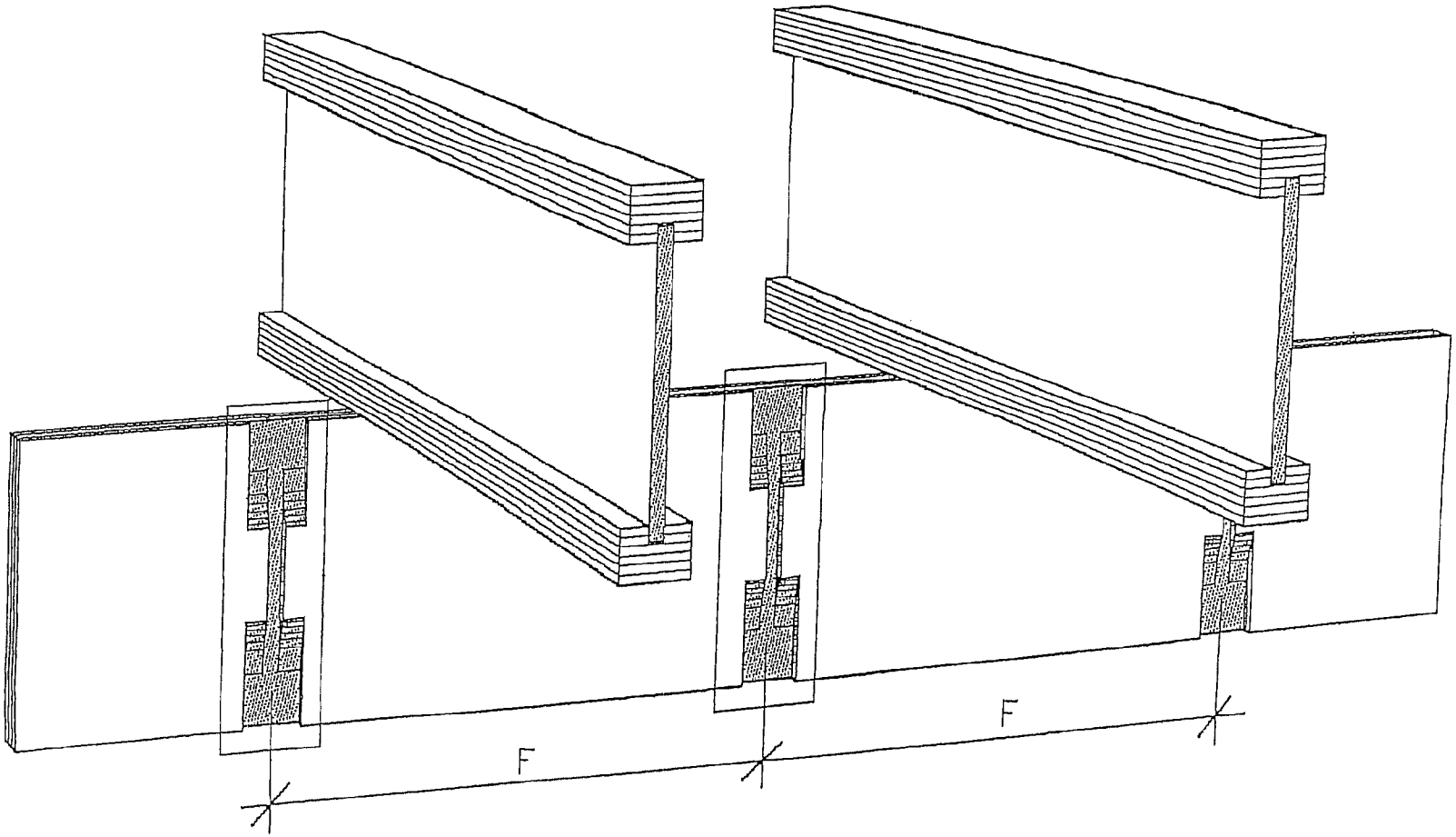

FIG. 7 portrays an embodiment wherein two I-joists are being installed in the profiled recesses of a rim board, in one embodiment wherein an insulated blocking panel according to the invention may be installed.

Figure 8:
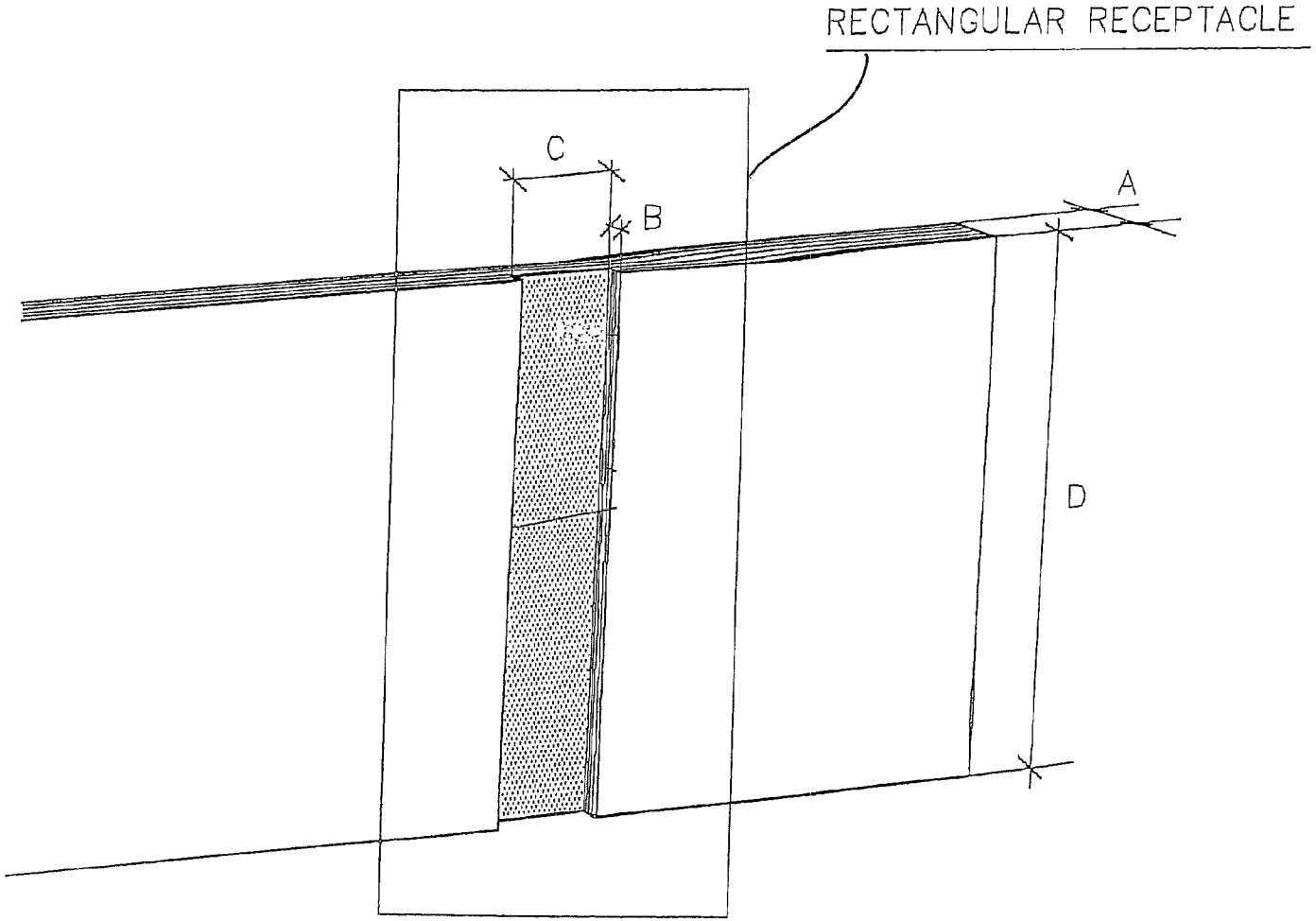

FIG. 8 portrays a close-up view of one embodiment of rectangular recess in a rim board.

Figure 9:
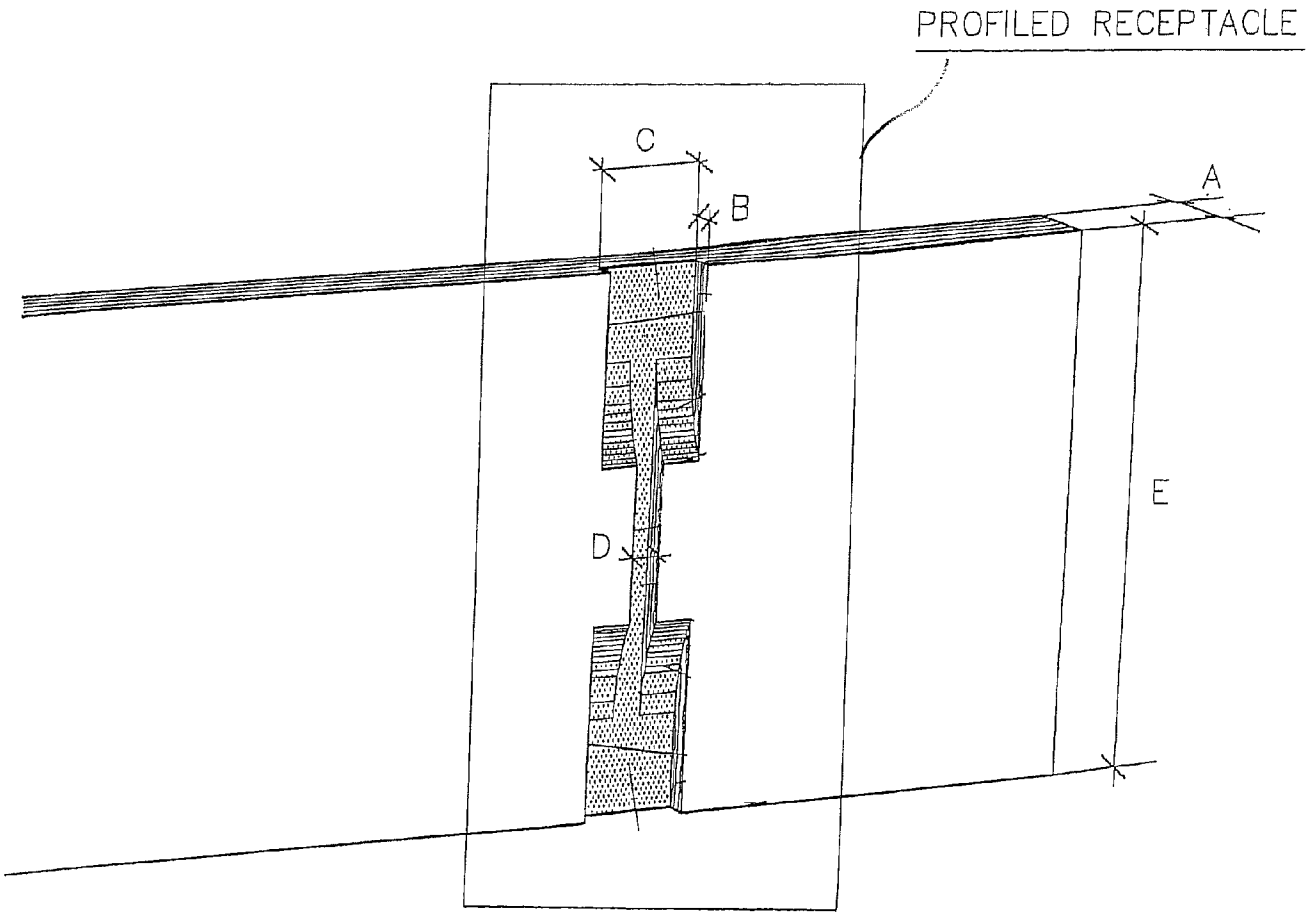

FIG. 9 portrays a close-up view of one embodiment of a profiled recess in a rim board.

Figure 10:
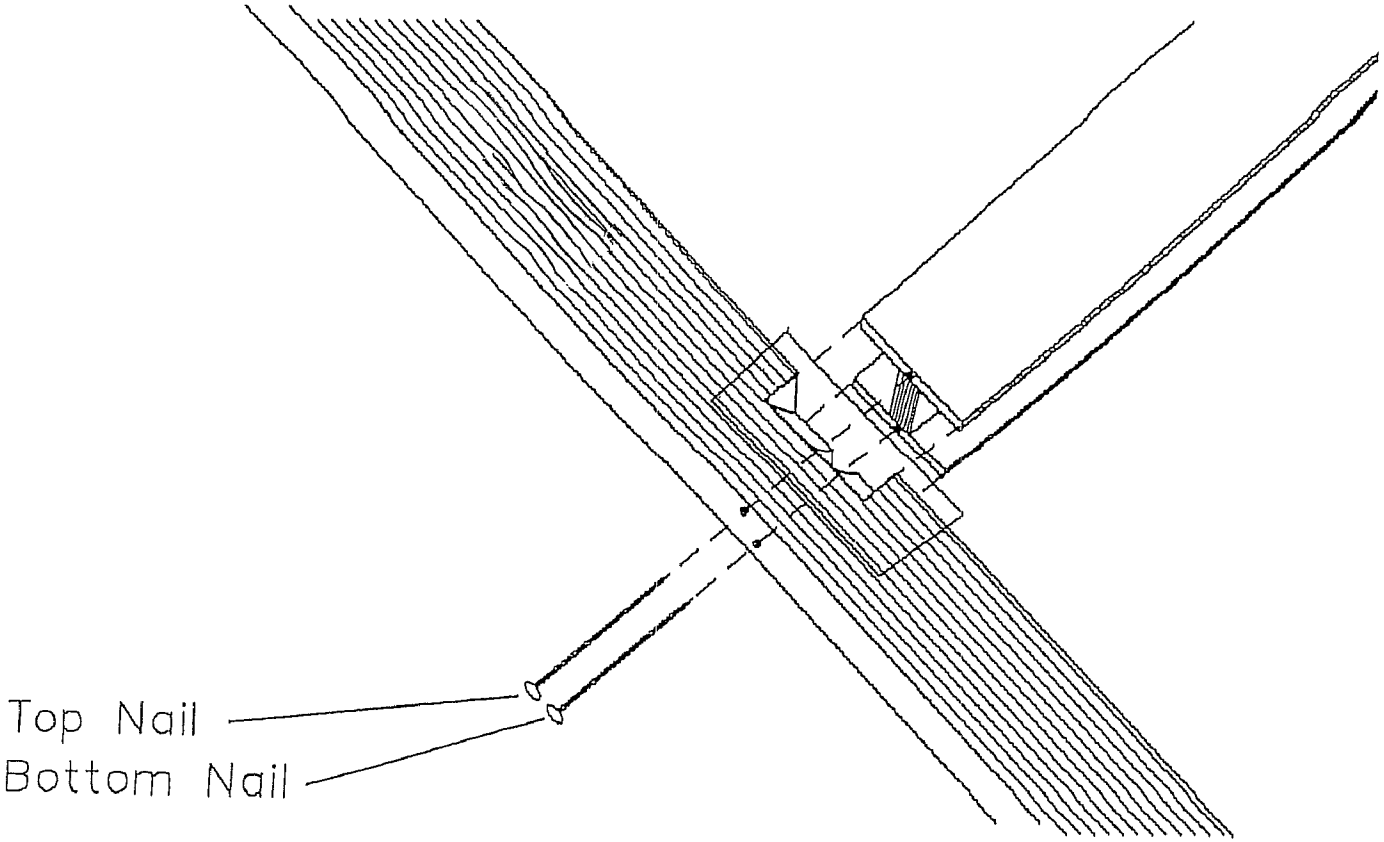

FIG. 10 illustrates a top view of one embodiment of connection and attachment between a profiled recess in a rim board and an I-joist.

Figure 11:
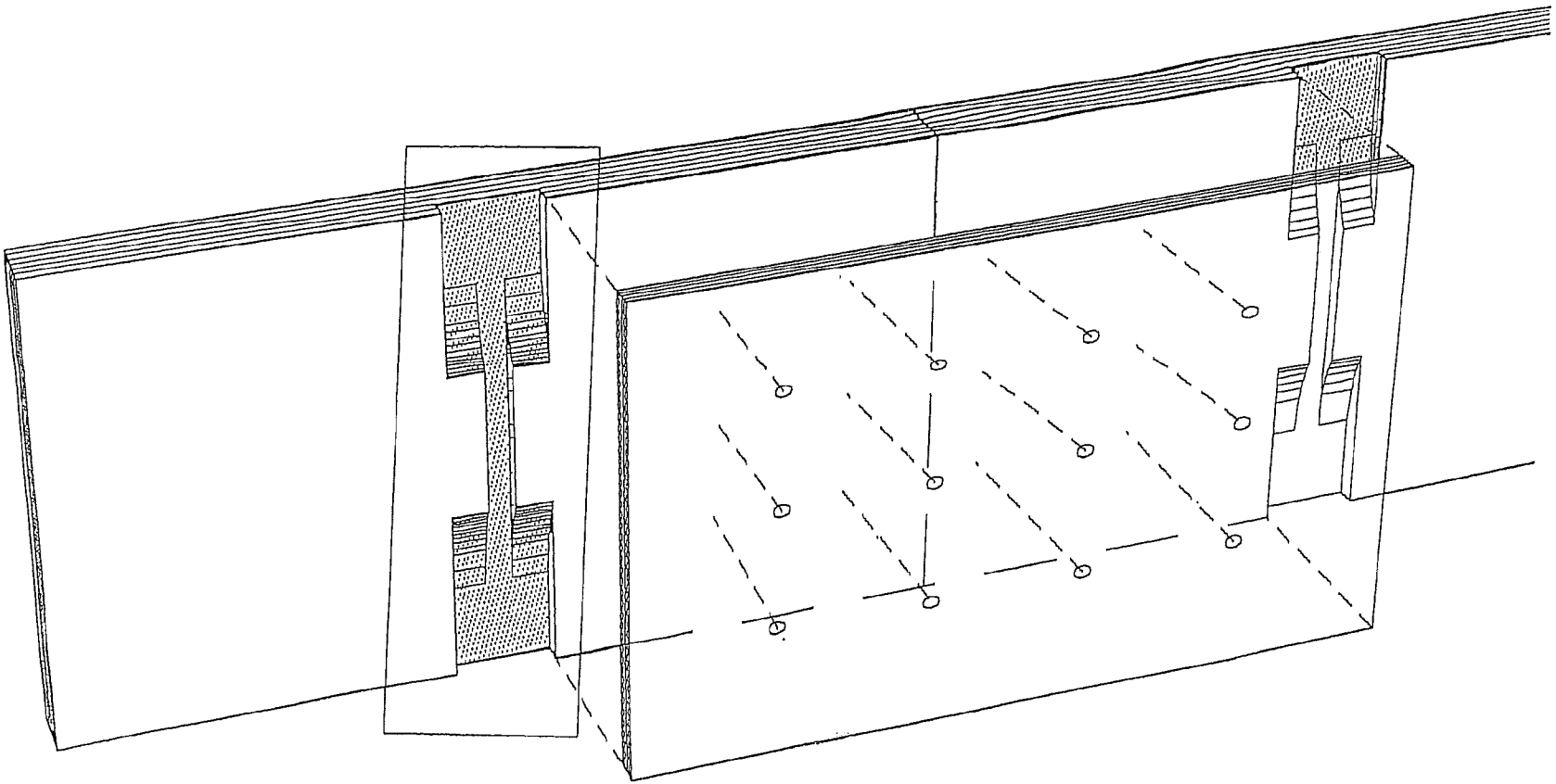

FIG. 11 illustrates one example of a method for connecting multiple rim boards.

Figure 12:
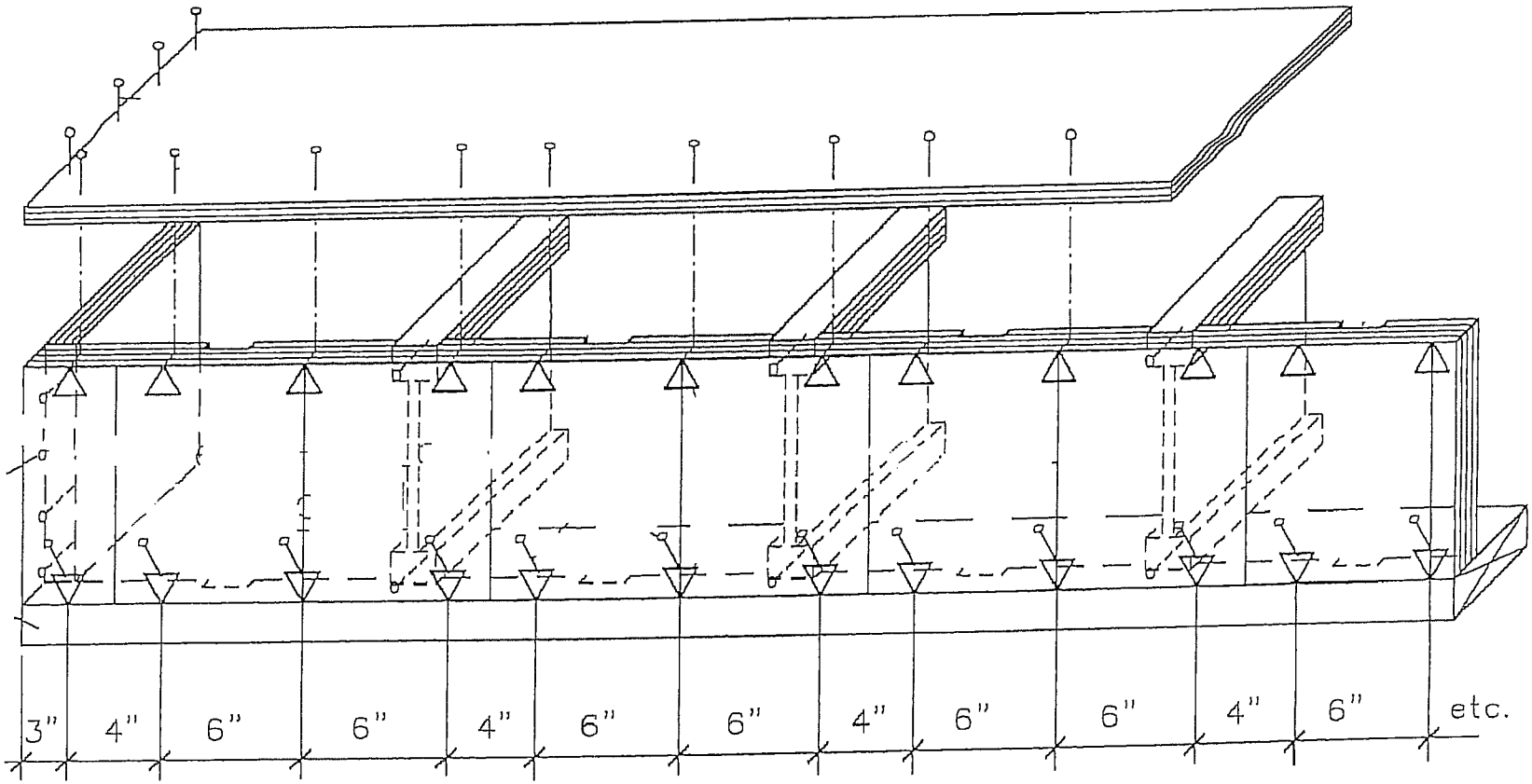

FIG. 12 portrays one embodiment of a modular assembly of rim boards with recesses, I-joists, on a plate and receiving a subfloor structure.

Figure 13:
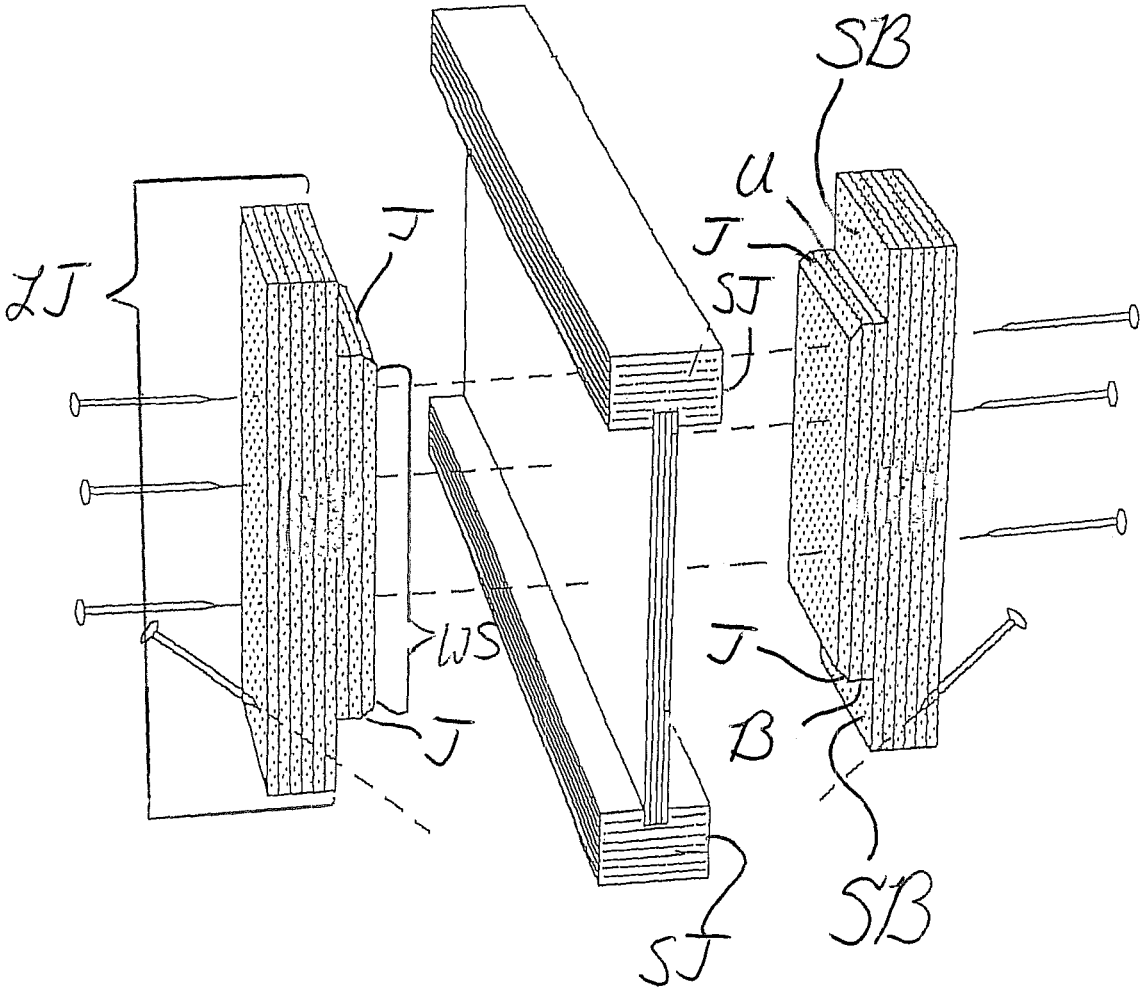
Figure 14A:
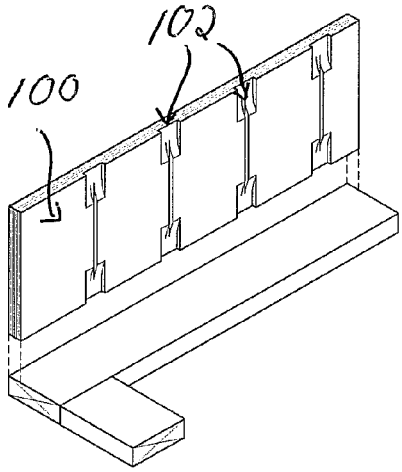
Figure 14B:
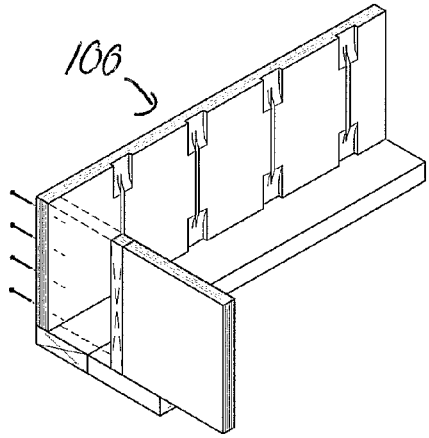
Figure 14C:
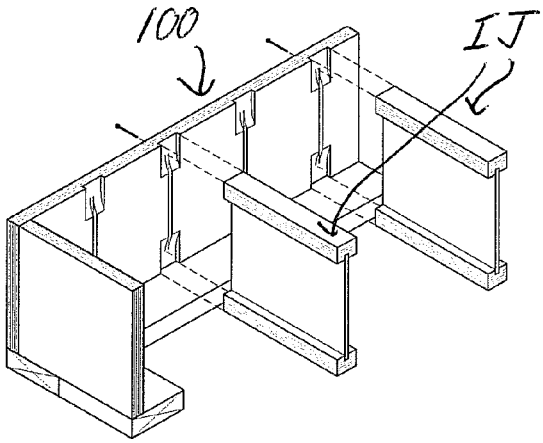
Figure 14D:
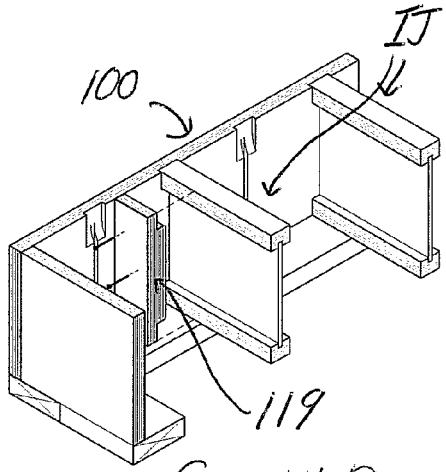
Figure 14E:
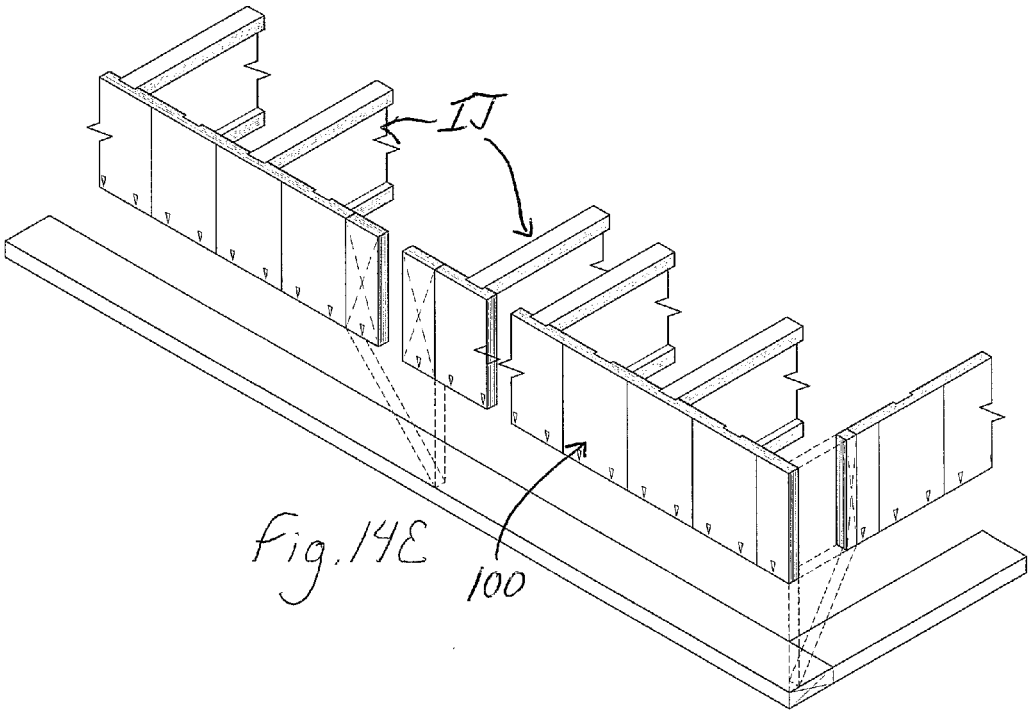
Figure 14F:
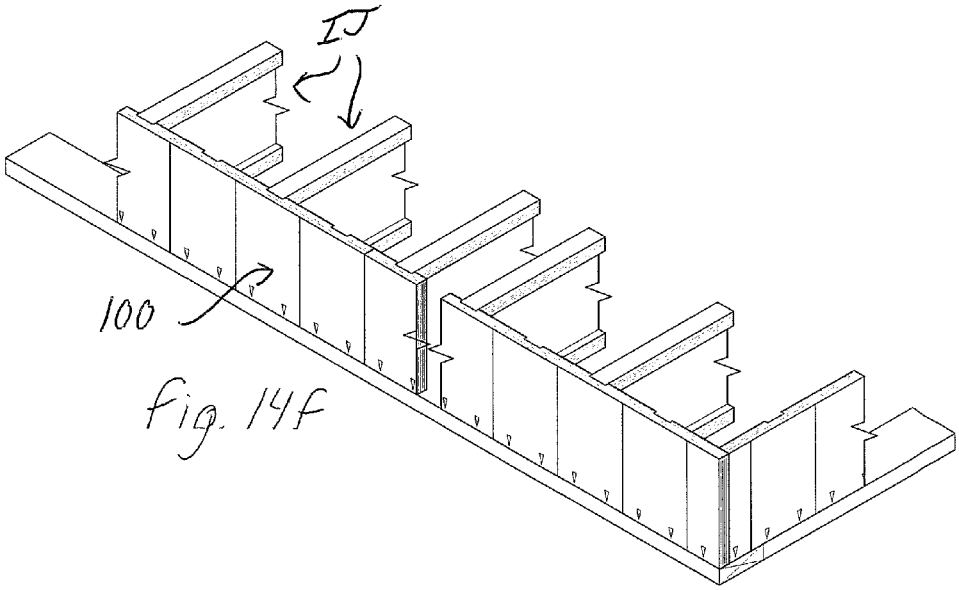
Figure 14G:
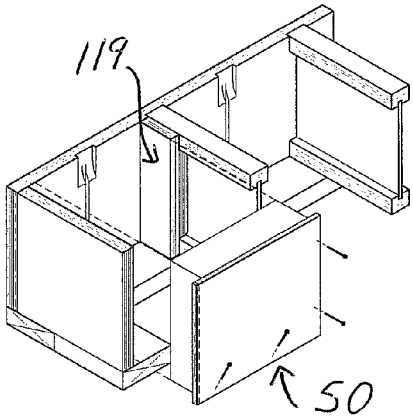
Figure 14H:
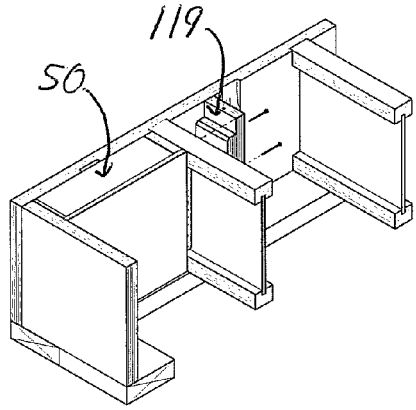
Figure 14I:
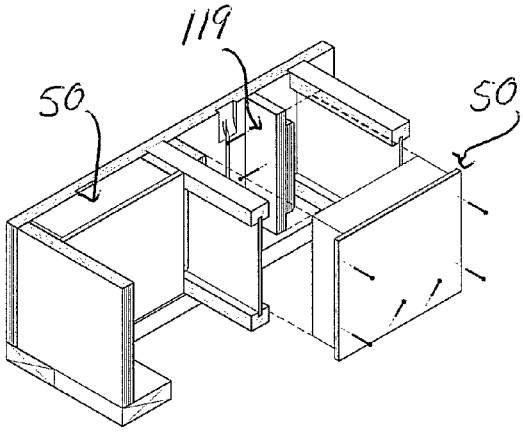
Figure 14J:
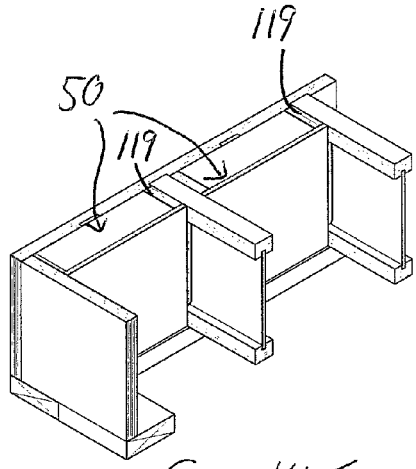
Figure 15A:
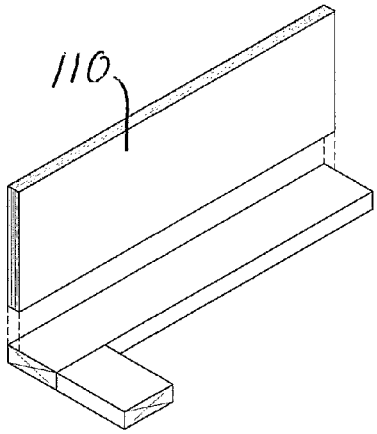
Figure 15B:
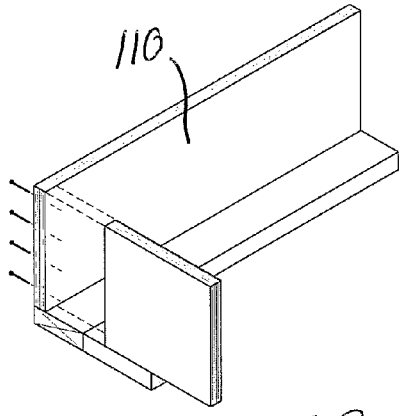
Figure 15C:
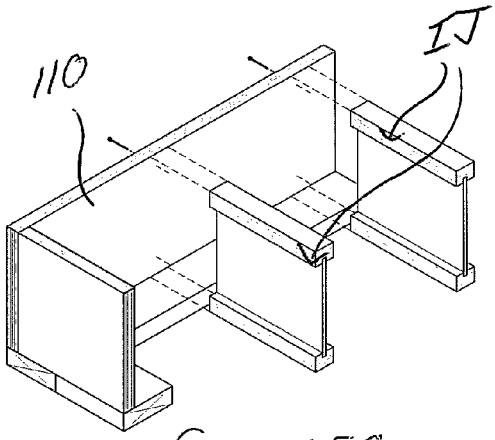
Figure 15D:
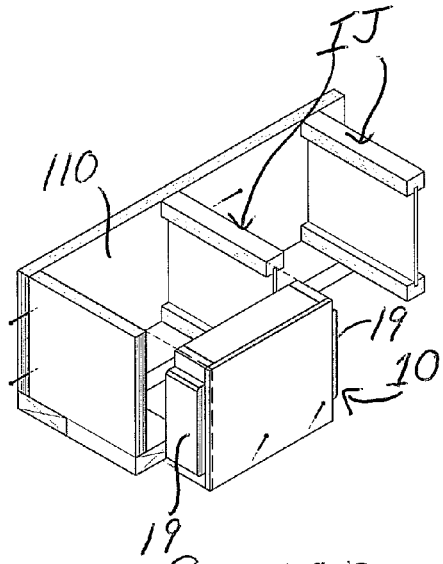
Figure 15E:
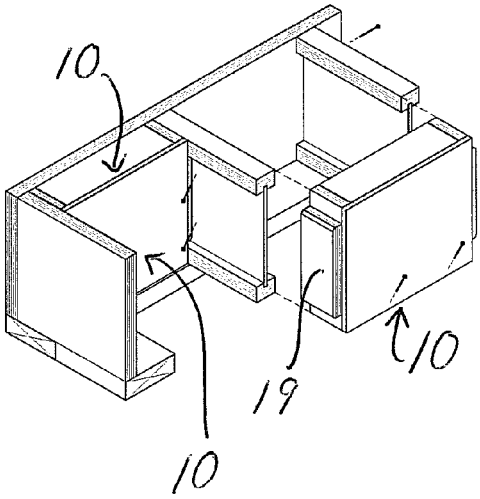
Figure 15F:
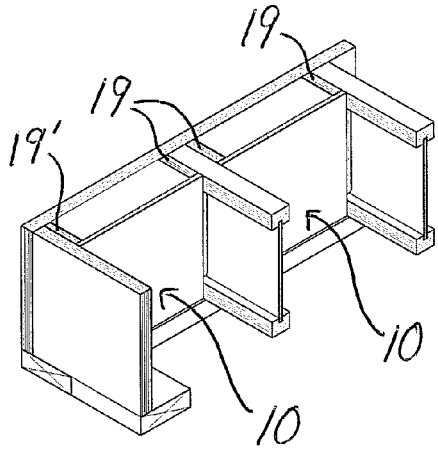
Figure 16A:
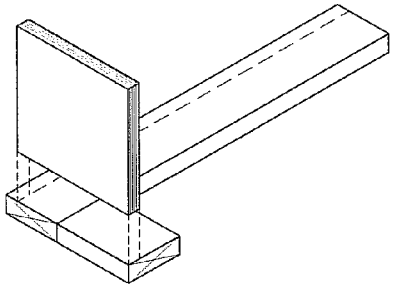
Figure 16B:
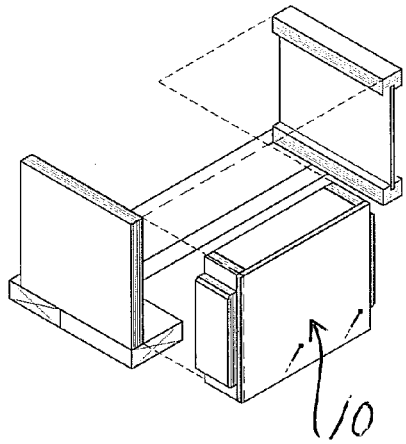
Figure 16C:
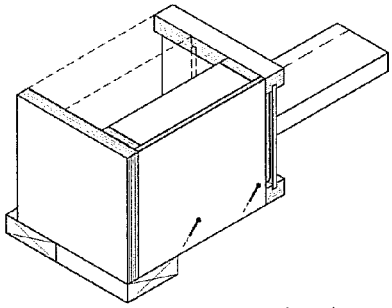
Figure 16D:
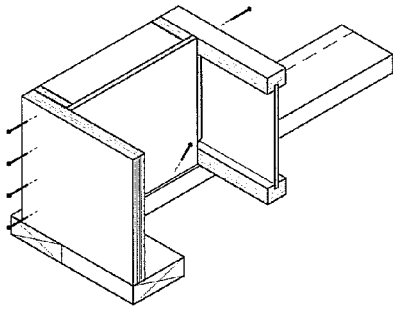
Figure 16E:
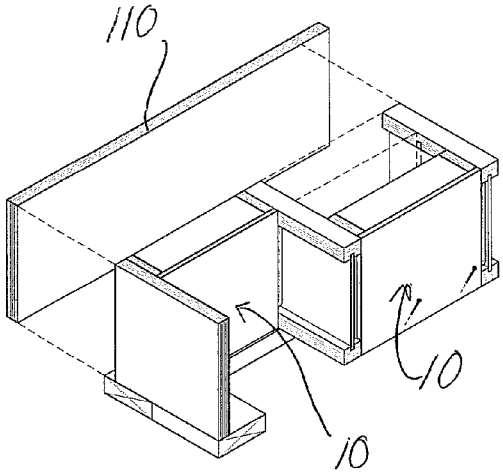
Figure 16F:
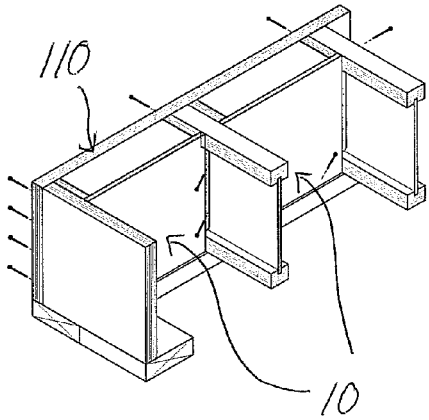
Figure 17A:
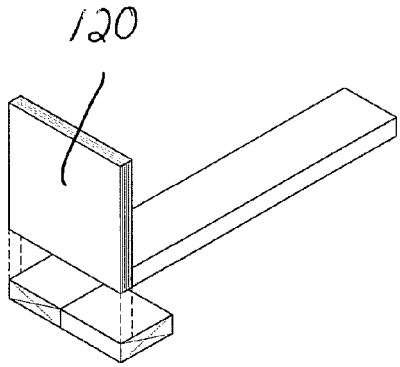
Figure 17B:
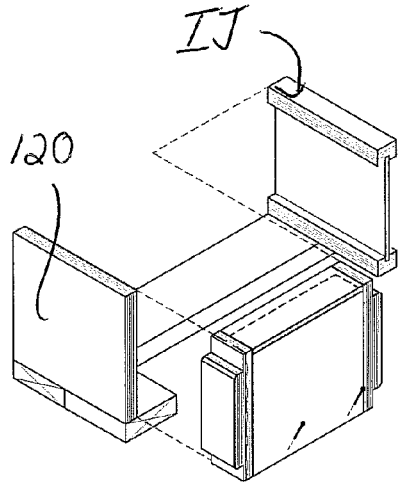
Figure 17C:
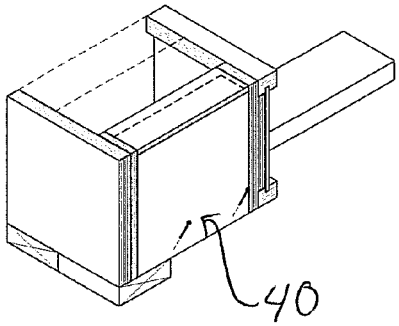
Figure 17D:
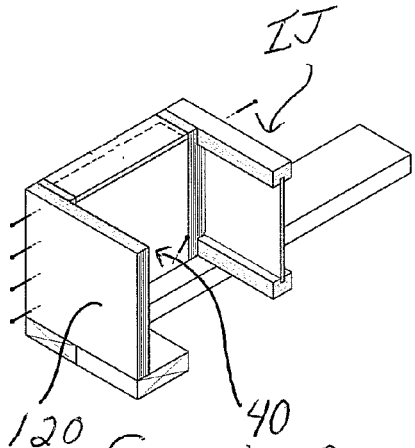
Figure 17E:
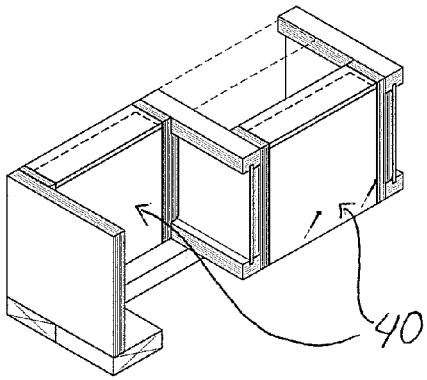
Figure 17F:
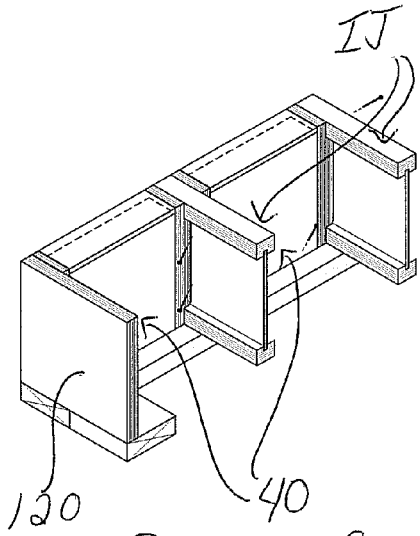
Figure 18A:
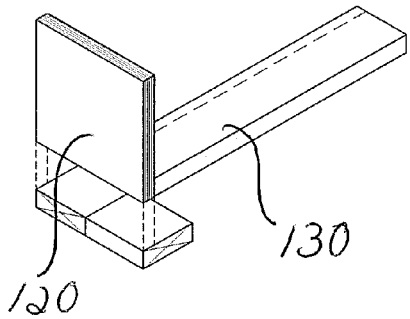
Figure 18B:
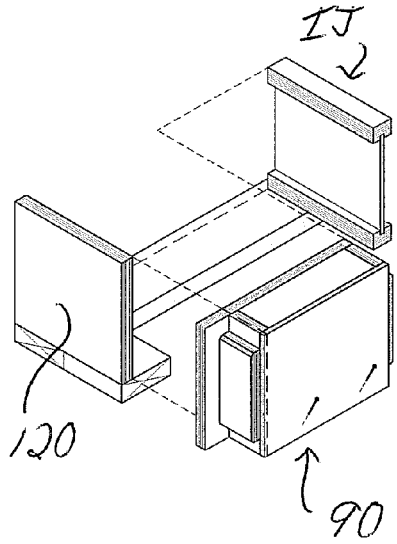
Figure 18C:
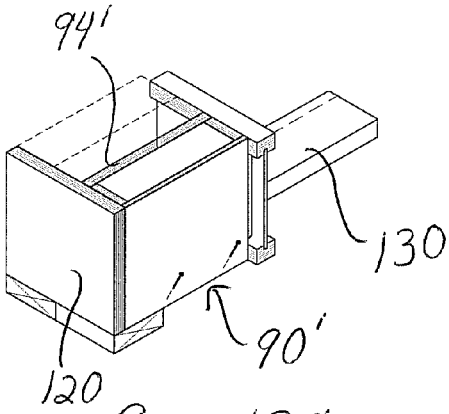
Figure 18D:
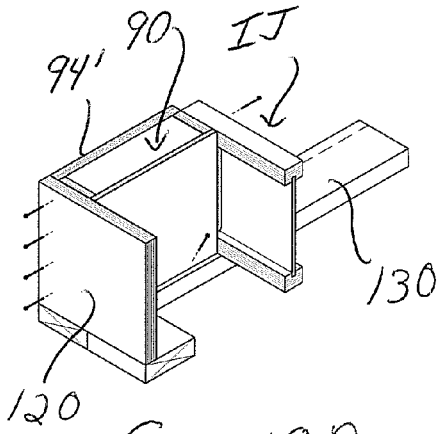
Figure 18E:
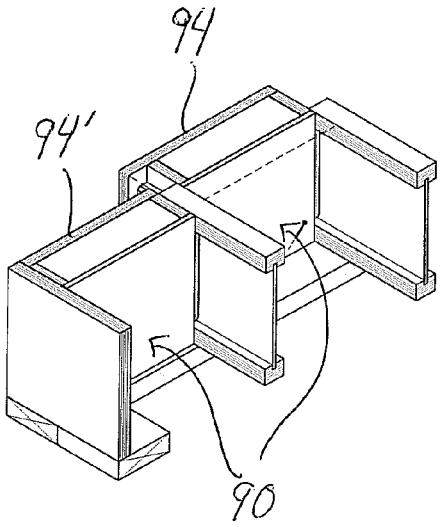
Figure 18F:
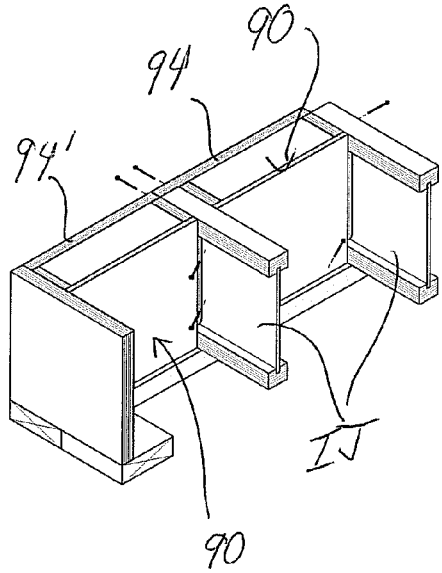

FIG. 13 illustrates one embodiment of separately-installed support blocks, which are nailed into the plate (for example, toe-nailing) and nailed through the main body of the support blocks into the web of the I-joists, but not nailed to the flanges of the I-joists. These support blocks each have a portion that extends to contact the web of the I-joist but not to touch or interfere with the underside of the upper flange, the upperside of the bottom flange, or the joints/corners between the flanges and the web. Said portion that contacts the web, therefore, should be sized to be slightly (a fraction of an inch, for example, 1/32-1/4 inch) shorter (from upper surface U to bottom surface B) than the total height of the web. Also, the corners of said portion J are milled, cut, or otherwise formed to avoid the joint/corner between the web and the flanges of the I-joist. Preferably, the support block side surfaces SB may contact I-joist flange side surfaces SJ.

FIGS. 14 A-J portray apparatus and method steps in one embodiment of an invented assembly, wherein separate support blocks are installed prior to installation of insulated blocking panels according to the embodiment of FIG. 3.

FIGS. 15A-F portray apparatus and method steps in another embodiment of an invented assembly, wherein insulated blocking panels according to FIG. 1A are installed between I-joists.

FIGS. 16 A-F portray apparatus and method steps in another embodiment of an invented assembly, wherein insulated blocking panels according to FIG. 1A are installed between I-joists, and a rim board without recesses is installed on the outside of the assembly.

FIGS. 17A-F portray apparatus and method steps in another embodiment of an invented assembly, wherein insulated blocking panels according to FIG. 2B are installed between I-joists.

FIGS. 18A-F portray apparatus and method steps in another embodiment of an invented assembly, wherein insulated blocking panels according to FIG. 5A are installed between I-joists.

Figure 19:
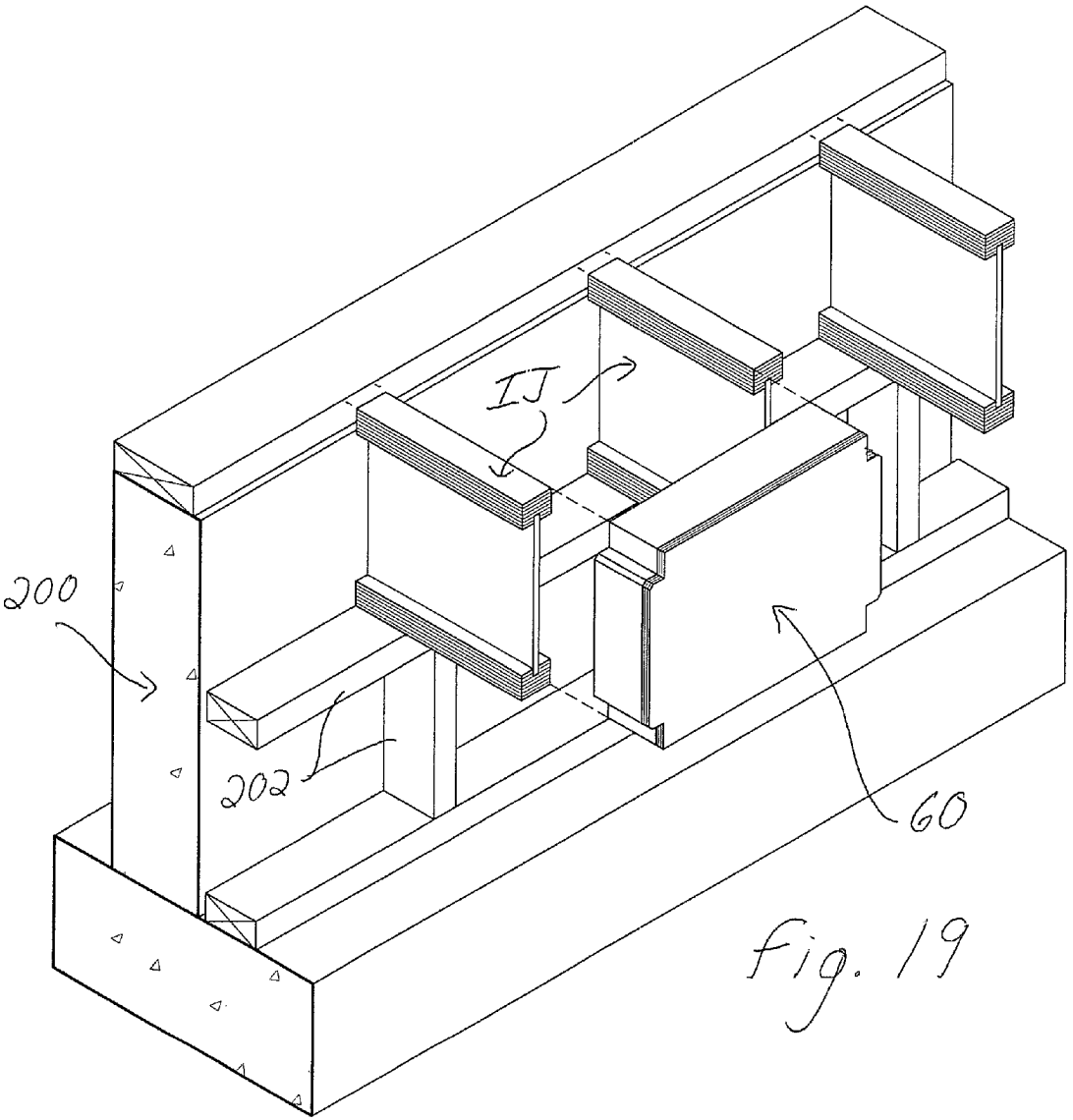

FIG. 19 portrays an assembly that is installed at or against a concrete wall rather than at or against a rim board or perimeter component system, wherein the assembly includes insulated blocking panels according to the embodiment shown in FIG. 4.

DESCRIPTION OF THE PREFERRED EMBODIMENTS

Referring to the Figures, there are shown several, but not the only, embodiments of the invented Insulated Blocking Panel and Assembly for I-Joist Installation in Floors and Ceilings and Methods for Installing Same. FIGS. 1A, 1B, 2A, 2B, 3, 4, 5A, and 5B illustrate some, but not the only, embodiments of the insulated blocking panels. The inventors believe these and other embodiments of the invented insulated blocking panels will be beneficial in many I-joist installations using conventional I-joists and conventional rim boards, and, also, in I-joist installations using their earlier-invented apparatus, including their invented rim boards and/or their invented, precision-machined support blocks.

Regarding embodiments such as those shown in FIGS. 1A, 1B, 2A, 2B, 5A, and 5B, for example, the support blocks are secured and immovably fixed to the foam board and/or the vertical structural panels, prior to installation and preferably at the time of manufacture. Such support blocks are therefore called "integral" support blocks. The term "integral," however, does not mean that the support blocks and the foam board are the same material or a single piece of material.

Regarding embodiments such as those shown in all of the Figures, the preferred inner vertical structural panel, and outer vertical structural panel and top structural panel (if present), are secured and immovably fixed to the foam board prior to installation, and preferably at the time of manufacture, and so the insulated blocking panel (including foam board, support blocks if present, inner vertical structural panel, and outer vertical and top structural panels if present) may be called a single unit or a unitary piece comprising multiple portions.

FIGS. 6-13 illustrate some, but not the only, invented assemblies and methods in which embodiments of the invented insulated blocking panels may be used. FIGS. 6-13 show some preferred embodiments disclosed in U.S. patent application Ser. No. 10/376,556, filed Feb. 27, 2003 and issued on Jun. 7, 2005 as U.S. Pat. No. 6,901,715, and in Continuation application Ser. No. 11/148,125, filed Jun. 7, 2005, by the instant inventors, the disclosure of which is incorporated herein by this reference. For example, rim boards with recesses and/or profiled recesses, and support blocks, from the above-mentioned patent/application may be used in preferred assemblies of the present invention. The methods of installing and using the rim board and support blocks, disclosed in the present inventors' above-listed patent applications/patent may be used in the assemblies in which the invented insulated blocking panels are installed. In cases wherein support blocks are supplied as integral portions of the insulated blocking panels, the structure and function of the support blocks is the same or generally the same as that described in the above applications/patent, but the nailing procedure will not require or allow nailing through the support blocks into the web of the I-joists, as the support block will be pre-attached to the other portions of the blocking panel and the support block surface for receiving the nails that might extend into the web will not be exposed for nailing into the web. As is important in the above applications/patent, nails should not be driven from the insulated blocking panels and/or their integral support blocks into the flanges of the I-joists.

For example, embodiments may include a rim board that is adapted to receive ends of I-joists by having multiple recesses. Preferably, the recesses are generally I-shaped. The recesses optionally may have contoured or curved surfaces (preferably contoured or curved back surfaces) for assistance in the installation and/or retention of the I-joist ends in the recesses. Alternatively, rim boards may be used that have recesses for receiving I-joists that are not I-shaped, and/or that have no recesses at all for receiving I-joists.

Also, alternatively, as will be discussed later in this document, some embodiments of the invention do not require any conventional rim board or recessed rim board. Some use no rim board or other perimeter board/components at all. Some embodiments are provided at or near concrete foundation walls rather than at or near rim boards. Some embodiments instead include insulated blocking panels that comprise perimeter structural panels that may serve a "rim" function without the need for the conventional or recessed rim boards.

The apparatus and methods of the present invention can improve the ease, speed, efficiency, and quality of the insulation application, to provide a high insulation value in addition to enhancing the structural strength and integrity of the floor or ceiling assembly. The preferably rigid or substantially rigid blocking panels cooperate with and/or enhance the modular spacing of I-joists that is preferred in embodiments of the invented assemblies, for example, pre-measured spacing of 16, 24, or 48 inch on center. The invented apparatus and method may be installed/performed before installation of the sub-floor/sheathing, so that the applicator is not transporting materials and working in a cramped crawl space. Thus, the preferred methods are "top down" installation during floor framing rather than "bottom up" installation from the crawl space after the floor has been built. The insulated blocking panels and resulting assemblies are tight and form-fitting with few or no gaps, resistant to air and moisture infiltration, durable, and generally more effective in terms of insulating the perimeter of a building compared to the batting that is conventionally "stuffed-in" from the crawl space and that is prone to sagging and dislocation. The insulated blocking panels reduce the possibility of mold and mildew compared to insulation that retains moisture. The combined benefits of the apparatus and methods provide an economically favorable and energy-saving scenario for insulating the perimeter of a floor. The preferred apparatus and methods provide effective perimeter insulation, which can be much more desirable and protective of heat ducts and pipes than insulating the entire floor area over the crawl space. Further, the apparatus and methods are effective for insulating the rim boards around the perimeter of multiple-story buildings.

An important feature of the preferred blocking panels and the resulting assemblies is their enhanced structural strength and stability. Whether the preferred insulated blocking panel comprises integral support blocks, or cooperates with separate support blocks, or has its own prefabricated profiled ends (such as the extension portions) but does not have or cooperate with support blocks, all of such preferred blocking panels increase vertical loading capabilities to the entire assembly. All of the vertical structural panels of the insulated blocking panels, and the support blocks if present, bear on the plate below the insulated blocking panel, and, hence, improve vertical loading capabilities. Therefore, when compared to a floor assembly with rim board alone, the preferred blocking panels provide additional and superior load distribution from the wall above to the plate below. Further, the blocking panels help "lock-in" the I-joists to resist lateral shear forces and prevent "roll-over."

FIGS. 1A and 1B illustrate an insulated blocking panel with two integral support blocks, wherein the insulated blocking panel 10 in FIG. 1A comprises an inner vertical structural panel 12 and the insulated blocking panel 20 in FIG. 1B comprises inner 22 and outer 24 vertical structural panels and also a top panel 26. Thus, the insulated blocking panel 10 in FIG. 1A comprises a foam board 18, lined on one surface (the "inner surface") with a vertical structural panel 12, and "capped" on both ends with precision pre-machined support blocks 19. The insulated blocking panel 20 in FIG. 1B comprises the foam board 28, lined on both inner and outer surfaces with vertical structural panels 22, 24, plus the top panel 26. Addition of a top panel 16 in FIG. 1B preferably is done in combination with a lower foam board 28, and lower inner and outer vertical structural panels 22, 24, so that the overall height of the insulated blocking panel 20 is the same as panel 10 in FIG. 1A. The top panel 26 is inserted between the tops of the integral support blocks 19. In FIG. 1A, the foam board 18 is considered the insulating portion, and the integral support blocks 19 and inner vertical panel 12 are considered the structural portion. In FIG. 1B, the foam board 28 is considered the insulating portion, and the integral support blocks 19 and inner and outer vertical panels 22, 24 are considered the structural portion. The optional top panel 26 may be considered a structural portion, but one that contributes to lateral load stability but not to vertical load capability.

For the general structure and function of the preferred support blocks 19, one may see the disclosure of the above-mentioned patent/application by the present inventors and FIG. 13, for example. One should note that there are important adaptations of the preferred support blocks that provide load-bearing capability without tending to damage the I-joists. The preferred support blocks are formed in size and shape to bear compressive load, by means of the outer "load jack" portion LJ of the support block extending all the way from a plane parallel to the bottom surface of the bottom I-joist flange to a plane parallel to the top surface of the top I-joist flange. This way, both the I-joist and the support block bear compressive load. Further, the preferred support blocks stabilize the I-joist to help prevent buckling, rolling or twisting of the I-joist under peak load conditions, by means of a web support portion WS of the support block that extends to contact the web of the I-joist and, preferably, to be nailed to the web. The preferred web support portion is formed in size and shape so that it does not abut against the flanges, and so does not tend to damage the connection between the flanges and the web. This protection of the flanges and the flange-web connection may be accomplished by 1) machining the edges of the web support portion to avoid glue beads at the connection between the flanges and the web; 2) making the entire web support portion slightly shorter (smaller in vertical dimension) than the inside distance between the flanges; and 3) forming the web support portion to protrude from the load-jack portion in such a position/location that the web portion preferably does not touch the I-joist flanges. Thus, each support block is a single, unitary piece that is shaped and sized for the above support and stabilizing functions without damaging the I-joist even under peak load conditions. When the support blocks are made "integral" with the other portions of the invented insulated blocking panel, the support blocks become part of a single, unitary blocking panel, but still retain the functions of the separate support blocks disclosed in the inventors' above-listed patents/applications.

In FIGS. 1A and 1B, one may note that the inner vertical structural panel 12, 22 is lapped outside of the support blocks 19, to extend along the load-jack portion of the support blocks. In other words, preferably one structural panel (the inner one) extends slightly beyond the end surfaces of the foam block. In the alternative insulated blocking panels 30, 40 in FIGS. 2A and 2B, on the other hand, the structural panel(s) 32, 42, 44 is/are flush with the innermost surface of the support blocks 19, that is, it preferably does not extend out past the end surfaces of the foam block.

FIG. 3 illustrates an insulated blocking panel 50 embodiment that includes a foam board 58 with attached inner structural panel 52, but without integral support blocks. This embodiment may still be used in combination with support blocks that are separately installed in the I-joist assembly ("field installation" of the support blocks) rather than being laminated (pre-attached) to the insulated blocking panel. The inner vertical structural panel 52 of the FIG. 3 embodiment extends past the end surfaces of the foam board 58 for over-lapping the cooperating field-installed support blocks. Said over-lapping will preferably mean that the inner vertical structural panel will extend along the inner side (toward the center of the floor/ceiling assembly) of the load-jack portion of the support blocks to reach the side surface of each of the upper and lower I-joist flange, but preferably will not extend into the I-joist web area. As this insulated blocking panel 50 is installed after the separately-installed support blocks, this blocking panel 50 may have an outer vertical structural panel (not shown), if desired, but not one as large as the inner vertical structural panel 52 shown in FIG. 3, because such a large outer vertical structural panel would abut into the support blocks and would probably prevent insertion of the blocking panel into the assembly.

FIG. 4 illustrates a "light duty" embodiment of the invented insulated blocking panel 60, which is not intended to be used in combination with support blocks (either integral or separate support blocks). Instead, the foam block 68 and the inner structural panel 62 of the insulated blocking panel 60 extend together farther in the transverse direction (transverse to the longitudinal axis of the I-joist) than in the embodiments of FIGS. 1-3, in order to substantially fill the space against the web and between the flanges. As in the preferred integral or separate support block design, however, these extending portions 65 (herein called "extensions" or "extension portions") of the insulated blocking panel preferably do not touch the bottom surface of the top flange, the upper surface of the bottom flange, or the corners/joints between the web and the flanges, but the preferred extension portions 65 do contact the web. One may see from FIG. 4 that one way of forming this embodiment is to make the insulating portion (foam board 68) and the inner vertical structural portion (panel 62) larger (in the transverse dimension) and to provide "notched-out corners" 67 in both that provide space and clearance to accommodate the flanges as discussed above in a manner that contacts the side surfaces of the flanges (for lateral support) but that avoids contact with the underside of the upper flange, the upperside of the bottom flange, and the corners/joints.

While not portrayed in the Figures, another embodiment similar to that shown in FIG. 4 may comprise an outer vertical structural panel that is sized and shaped the same as the inner vertical structural panel 62 of FIG. 4. In such an embodiment, the extension portions would, therefore, consist of portions of the foam board and both inner and outer vertical structural panels extending to contact the web of the I-joists on each end of the insulated blocking panel and to substantially fill the space between the flanges of each I-joist, but, again, avoid certain flange areas, as discussed above.

FIGS. 5A and 5B illustrate embodiments of the invented insulated blocking panel 70, 80 that have a vertical structural panel 72, 82 on the inner surface of the foam board 78, 88, which vertical structural panel 72, 82 is lapped to extend along the load jack portions of the support blocks 19. The outer structural panel (shown away from the viewer) is preferably thicker and stronger than the outer vertical support panels of FIGS. 1B and 2B, and serves as a perimeter component 74, 84 in place of a rim board. The perimeter component 74, 84 is lapped equally at both ends to extend slightly beyond the web support portions of the support blocks 19, for being centered on the I-joists. Alternatively, the perimeter component may be lapped unequally at the ends, for example, so that one end extends just along the load-jack portion of the support block, but the other end extends farther in order to cover the full width of the I-joist on that end of the insulated blocking panel. In other words, in alternative embodiments, the perimeter component may be offset to extend out much farther on one end than the other. See, for example, FIGS. 18A-F. This way, the extending part of the perimeter component can cover the full width of one I-joist, and each insulated blocking panel therefore extends to cover just one of the I-joists adjacent to it.

Following are examples of some, but not all, embodiments of the invented insulated blocking panel and installation methods, as they may be included in invented I-joist assemblies. See, also, the disclosure of U.S. patent application Ser. No. 10/376,556, filed Feb. 27, 2003 and Continuation application Ser. No. 11/148,125, filed Jun. 7, 2005, some of the figures of which are included as FIGS. 6-13. The insulated blocking panels are preferably secured into position by nailing through at least one (preferably the inner) vertical structural panel into the plate 130, pony wall 202, or other structure below the blocking panel. Alternatively or additionally, nails may extend from the outside of the rim board and through the rim board, if present, into integral support blocks provided as part of some embodiments of the insulated blocking panel. Nailing techniques and/or numbers of nails should not be done/used that compromise the strength and durability of the I-joists, as will be understood by those of skill in the art.

ASSEMBLY EXAMPLES

FIGS. 14A-J illustrate use of a rim board 100 with "I-shaped" recesses 102 (or "receptacles") that include one embodiment of curved or "profiled" walls, and one embodiment of the invented insulated blocking panel 50 being inserted between the "support-block-lined" I-joists IJ. The separately-installed support blocks 119 are installed prior to the insulated blocking panel is installed. This insulated blocking panel is of the type shown in FIG. 3, described above. One may see to best advantage in FIGS. 14I and 14J how the final assembly provides substantial support, securement, and insulation of the I-joist assembly, wherein, in addition to the load and shear benefits, several-inch thick insulation is provided by the substantially inflexible, durable, precise and form-fitting insulated blocking panels between each two I-joists.

FIGS. 15A-F illustrate use of one embodiment of an insulated blocking panel 10 with a rim board 110 that does not have I-joist-receiving recesses/receptacles. The insulated blocking panel used in this assembly comprises attached/integral support blocks 19 (19' being partially cut off), and is of the type shown in FIG. 1A, described above. It should be noted that similar installation steps also could be used with the insulated blocking panel of FIGS. 1B, 2A and 2B. Note that the difference between FIGS. 1A and 1B, and the difference between FIGS. 2A and 2B, is the addition of an outer vertical structural panel and a top panel, which could be added as a feature in the assembly of FIGS. 15 A-F, is desired. Again, one may see to best advantage in FIGS. 15E and 15F how the final assembly provides substantial support, securement, and insulation of the I-joist assembly, wherein, in addition to the load and shear benefits, several-inch thick insulation is provided by the substantially inflexible, durable, precise and form-fitting insulated blocking panels between each two I-joists.

FIGS. 16A-F illustrate an assembly wherein the insulated blocking panels 10 according to one embodiment of the invention are used as spacers during the placement of the I-joists. See especially FIGS. 16A-D. A conventional rim board 110 may then be installed, as in FIGS. 16E and F, for example. The insulated blocking panel 10 used in this assembly again comprises attached/integral support blocks, as in the type shown in FIG. 1A described above. Similar installation steps could be used with the blocking panels of FIGS. 1B, 2A and 2B. Again, one may see to best advantage in FIG. 16F, how the final assembly provides substantial support, securement, and insulation of the I-joist assembly, wherein, in addition to the load and shear benefits, several-inch thick insulation is provided by the substantially inflexible, durable, precise and form-fitting insulated blocking panels between each two I-joists.

FIGS. 17A-F illustrate an assembly wherein the insulated blocking panels 40 according to one embodiment of the invention are used as spacers during the placement of the I-joists, and the assembly does not comprise a rim board perpendicular to the lengths of the I-joists. Note that it may be convenient to use a "side" rim board 120 parallel to the I-joists. In other words, the final assembly does not include either a recessed rim board or a non-recessed rim board at the ends of the I-Joists. The insulated blocking panel 40 used in this assembly again comprises attached support blocks, and is of the type shown in FIG. 2B, preferably having a top panel and an outer vertical structural panel. Similar installation steps might be used with the installation of the blocking panels of FIG. 1B; it is preferred that blocking panels be used that have both inner and outer vertical structural panels. In this embodiment, wherein the insulated blocking panels are used as spacers, there is preferably no addition of a rim board after installation of several I-joists and insulated blocking panels. Instead, the outer surface of the I-joists and the outer surface of the insulated blocking panel (preferably an outer vertical structural panel) will be visible from outside the assembly. Again, the final assembly provides substantial support, securement, and insulation of the I-joist assembly, wherein, in addition to the load and shear benefits, several-inch thick insulation is provided by the substantially inflexible, durable, precise and form-fitting insulated blocking panels between each two I-joists.

FIGS. 18A-F illustrate an assembly wherein the insulated blocking panels 90 according to embodiments of the invention are used as spacers during the placement of the I-joists IJ on plate 130, but the assembly does not comprise a conventional rim board or recessed rim board at the ends of the I-joists. Note that it may be convenient to use a "side" rim board 120 parallel to the I-joists. In other words, the final assembly does not include either a recessed rim board or a non-recessed conventional rim board at the ends of the I-Joists. Instead, an outer structural panel 94 similar to that is described earlier in this document as a "perimeter component" or "perimeter panel" 74, 84 is provided on each insulated blocking panel, in a similar manner as shown in FIGS. 5A and 5B except that, in this assembly, the perimeter panel 94 is offset all the way to extend from only one end of the blocking panel. The perimeter panel 94 is of such dimensions so that the multiple perimeter panels together form a "rim" or "perimeter" around the assembly. This perimeter panel 94 of each insulated blocking panel (except near the side rim board 120) is lapped unequally at the ends, so that one end extends just along the load jack portion of the support block, but the other end extends farther to cover the full width of the I-joist. This way, the perimeter panels 94 of adjacent insulated blocking panels abut against each other, to form a nearly-continuous rim (with seams between the adjacent perimeter panels, but no gaps large enough to reveal the end surfaces of the I-joists). It may be noted, however, that insulated blocking panels 90' near the side rim board 120 have their perimeter panels 94' cut or formed to not extend past the foam board, so that they will fit with the side rim board 120 and the adjacent perimeter panel 94. Again, the final assembly provides substantial support, securement, and insulation of the I-joist assembly, wherein, in addition to the load and shear benefits, several-inch thick insulation is provided by the substantially inflexible, durable, precise and form-fitting insulated blocking panels between each two I-joists. Note that the insulated blocking panels, with their perimeter panels, are inserted/slid into the assembly of FIGS. 18 A-F from the outside, as the dimensions of the perimeter panels will otherwise not allow installation when the I-joists are already in their preferred locations and spacing.

While the insulated blocking panel of FIG. 4 is not shown in the assemblies of FIGS. 14A-J, 15A-F, 16A-F, 17A-F, and FIGS. 18A-F, it will be understood from this disclosure that the FIG. 4 embodiment could be substituted in many assemblies shown therein, in instances wherein the construction is considered "light duty." For example, the insulated blocking panels of 15A-F, 16A-F, and 17A-F, which comprise integral support blocks, may be replaced with an insulated blocking panel the same or similar to that in FIG. 4, which would have profiled end surfaces. In such cases, the extension portions of the insulated blocking panel of FIG. 4 would take the place of the integral support blocks in location and general function, but would not have as great a load capability. The inner vertical structural panel (and outer vertical structural panel, if present) would provide some vertical load capability and lateral shear resistance and the several-inch thick insulation described above. Therefore, such an assembly would be for "light duty" applications, and wherein the insulated blocking panel would still provide substantially inflexible, durable, precise and form-fitting insulated blocking panels between each two I-joists.

FIG. 19 illustrates an assembly wherein the I-joists IJ are installed at or near a concrete foundation wall 200, for example, by placement on a pony-wall 202, by being hung in metal hangers, or by other means. An insulated blocking panel 60 according to FIG. 4 is provided in this assembly. This may be, for example, because the installation is a light-duty application, or because the additional vertical load capability of the insulated blocking panel is not of primary importance in view of the presence of the concrete wall. Still, the insulation properties and lateral shear resistance properties of the insulated blocking panels are beneficial in this assembly, as discussed above.

The choice of including a top structural panel above the insulated blocking panel is usually made to enhance the structure available for, and the security and strength of, nailing of floor sheathing into proper position. Depending on the thickness of the rim board or other outer perimeter panels, if present, one may use said top structural panel to provide adequate edge nailing of the floor sheathing diaphragm. The top structural panel may be attached to the other portions of the insulated blocking panel by adhesive, glues, foam and/or other structural bonding agents.

The invention may comprise apparatus and/or methods for spacing, securing, and stabilizing I-joists at their ends, and insulating and structural enhancing I-joist assemblies, may be provided around the perimeter, or in the interior, of a floor or ceiling where ends of I-joists are located. In some embodiments, I-joists may be connected to a rim board with insulated blocking panels provided against the rim board and between the I-joists. In other embodiments, I-joists may be connected to insulated blocking panels, wherein there is no conventional or recessed rim board at the ends of the I-joists. In some instances wherein there is no conventional or recessed rim board, outer structural panels may be provided on the insulated blocking panels for extending along the ends of the I-joists to form a rim structure (in lieu of a conventional or recessed rim board) that is formed by the multiple structural panels reaching near to, or abutting, each other at their end surfaces. Insulated blocking panels may comprise a main body (which may comprise or consist of an insulating portion and a structural portion, and which may optionally be used in combination with field-installed support blocks), or, alternatively, support blocks may be attached to said main body at the time of manufacture. Alternatively, in floor and ceiling assemblies not utilizing support blocks, the insulated blocking panels (main panel comprising or consisting of insulating portion plus structural portion) may be formed to themselves extend to the web of each I-joist, to fill in the space between the I-joists near the I-joist ends, including a substantial amount of the space immediately adjacent the web of each I-joist. The insulated blocking panels preferably provide excellent insulation of the floor or ceiling assembly, by filling all or nearly all of the space between the I-joists, or (in cases using field-installed support blocks) by filling all or nearly all of the space between the support blocks, with a high R insulating material. By using embodiments of the invented insulated blocking panels, an I-joist assembly may be efficiently, effectively, and accurately insulated, as well as being structurally enhanced.

In some embodiments, the invented assemblies may be described as: a floor or ceiling assembly comprising: a first I-joist and a second I-joist spaced along a perimeter of a floor or ceiling and said first and second I-joists each having a length, a web, and an upper flange and a lower flange; a first support block and a second support block, wherein the first support block is attached to the web of said first I-joist, and said second support block is attached to the web of said second I-joist, wherein each support block has a load jack portion that extends along side surfaces of the upper flange and the lower flange of its respective I-joist, and a web support portion that contacts the web of its respective I-joist, wherein each support block does not contact any lower surface of the upper flange of its respective I-joist and each support block does not contact any upper surface of the lower flange of its respective I-joist; and an insulated blocking panel located between the first and second support blocks and transverse to the lengths of the I-joists, said insulated blocking panel comprising: and an insulating portion and a structural portion attached to the insulating portion, wherein the structural portion is rigid and vertically-load-bearing. The insulating portion may be a foam board and said structural portion may comprise an inner vertical structural panel attached to an inner surface of said foam board, wherein said inner surface faces generally toward a center of the floor or ceiling assembly. The structural portion may further comprise an outer vertical structural panel attached to an outer surface of said foam board. The insulated blocking panel may comprise a top panel attached to a top surface of said foam board and covering said top surface. A rim board may be located at, and attached to, ends of the I-joists and contacting an outer surface of said foam board of the insulated blocking panel, and the rim board may comprise a first and a second recess spaced apart and receiving the first I-joist and the second I-joist, respectively. The first and second support blocks may be fixed to the first and second I-joists, respectively, prior to the installation the insulated blocking panel in between the first and second I-joists, for example, said first and second support blocks may be fixed to the first and second I-joist by nails that extend through said supports blocks and into the web of their respective I-joists. Alternatively, said first and second support blocks may be fixed to the insulated blocking panel prior to installation of the first and second support blocks and the insulated blocking panel between the first and second I-joists, for example, by the first and second support blocks being glued to the insulated blocking panel. The first and second I-joists, said first and second support blocks, and said insulated blocking panel may all rest on a horizontal plate, wherein said insulated blocking panel is nailed to said horizontal plate by nails that extend at a non-vertical and a non-horizontal into the horizontal plate. The insulated blocking panel may comprises a perimeter panel on an outer surface of said foam board that is adhesively fixed to said foam board and that is thicker than said inner vertical structural panel, wherein such a perimeter panel is typically used in lieu of a rim board. The insulating blocking panel may be inflexible.

Other embodiments of the floor or ceiling assembly may be described as comprising: first and second I-joists spaced along a perimeter of a floor or ceiling and said first and second I-joists each having a length, a web, and an upper flange and a lower flange; an insulated blocking panel extending between said first and second I-joist transverse to the lengths of said first and second I-joists, wherein said insulated blocking panel has a first and a second extension portion that extend to contact the webs of said first and said second I-joists, respectively, and wherein the insulated blocking panel has upper and lower corners surfaces near said first and second extension portions that extend along side surfaces of the upper flange and the lower flange, respectively, of the respective I-joist, and wherein the insulated blocking panel does not contact any lower surface of the upper flange of any I-joist and the insulated blocking panel does not contact any upper surface of the lower flange of any I-joist; wherein said insulated blocking panel comprises at least one insulating layer and at least one structural layer attached to the at least one insulating layer, wherein the at least one structural layer is rigid and vertically-load-bearing and the at least one insulating layer extends substantially all the way between the upper flange side surfaces of the first and second I-joists, substantially all the way between the lower flange sides surfaces of the first and second I-joists, and substantially all the way between the webs of the first and second I-joists. Said insulated blocking panel may be inflexible. Said at least one insulating layer may be, or may comprise, a foam board. Said at least one structural layer may be a rigid vertical panel fixed to an inner surface of the foam board. A rim board may be located at ends of the I-joists and contacting an outer surface of said foam board of the insulated blocking panel, wherein said rim board may comprise spaced recesses receiving ends of said first I-joist and the second I-joist. Said first and second I-joists and said insulated blocking panel may all rest on a horizontal plate, and said insulated blocking panel may be nailed to said horizontal plate by nails that extend at a non-vertical and a non-horizontal into the horizontal plate. Alternatively, said first and second I-joists and said insulated blocking panel may all rest on a pony-wall near a concrete foundation wall, and said insulated blocking panel may be nailed to said pony-wall by nails that extend at a non-vertical and a non-horizontal into the pony-wall.

Some embodiments of the preferred insulated blocking panels may be said to consist essentially of, or even to consist of, a vertical structural panel immovably fixed to an insulating panel/board, wherein the ends of the insulated blocking panels extend into the web areas of an I-joists between, and preferably not touching the under side of each respective top flange and preferably not touching the top side of the respective bottom flange. Other embodiments of the preferred insulated blocking panels may be said to consist essentially of, or even to consist of, a vertical structural panel immovably fixed to an insulating panel/board, and two Support blocks immovably fixed to the ends of the insulating panel/board and the vertical structural panel, wherein each support block extend into the web area of an I-joist between, and preferably not touching the under side of the top flange and preferably not touching the top side of the bottom flange. Each of these two embodiments, however, may in some circumstances also comprise a second vertical structural panel, for example, so that the insulating panel/board is "lined" on its inner and its outer surfaces by said vertical structural panels.

Although this invention has been described above with reference to particular means, materials and embodiments, it is to be understood that the invention is not limited to these disclosed particulars, but extends instead to all equivalents within the broad scope of the following claims.

The invention claimed is:

1. A floor or ceiling assembly comprising:

a first I-joist and a second I-joist spaced along a perimeter of a floor or ceiling and said first and second I-joists each having a length, a web, and an upper flange and a lower flange;

a first support block and a second support block;

wherein the first support block is attached to the web of said first I-joist and has a load jack portion that extends along side surfaces of the upper flange and the lower flange of the first I-joist, and a web support portion that contacts the web of the first I-joist, wherein said first support block does not contact any lower surface of the upper flange of the first I-joist does not contact any upper surface of the lower flange of the first I-joist; and wherein said second support block is attached to the web of said second I-joist and has a load jack portion that extends along side surfaces of the upper flange and the lower flange of the second I-joist, and a web support portion that contacts the web of the second I-joist, wherein said second support block does not contact any lower surface of the upper flange of the second I-joist and said second support block does not contact any upper surface of the lower flange of the second I-joist; and an insulated blocking panel located between the first and second support blocks and transverse to the lengths of the I-joists, said insulated blocking panel comprising:

an insulating portion and a structural portion attached to the insulating portion, wherein the structural portion is rigid and vertically-load-bearing.

2. The assembly as in claim 1, wherein said insulating portion is a foam board and said structural portion comprises an inner vertical structural panel attached to an inner surface of said foam board, wherein said inner surface faces generally toward a center of the floor or ceiling assembly.

3. The assembly as in claim 2, wherein said structural portion further comprises an outer vertical structural panel attached to an outer surface of said foam board.

4. The assembly as in claim 3, further comprising a top panel attached to a top surface of said foam board and covering said top surface.

5. The assembly as in claim 2, further comprising a rim board located at, and attached to, ends of the I-joists and contacting an outer surface of said foam board of the insulated blocking panel.

6. The assembly as in claim 5, wherein said rim board comprises a first and a second recess spaced apart and receiving the first I-joist and the second I-joist, respectively.

7. The assembly as in claim 2, wherein said insulated blocking panel further comprises a perimeter panel on an outer surface of said foam board that is adhesively fixed to said foam board and that is thicker than said inner vertical structural panel.

8. The assembly as in claim 1, wherein said first and second support blocks are fixed to the first and second I-joists, respectively, prior to the installation the insulated blocking panel in between the first and second I-joists.

9. The assembly as in claim 8, wherein said first and second support blocks are fixed to the first and second I-joist by nails that extend through said supports blocks and into the web of their respective I-joists.

10. The assembly as in claim 1, wherein said first and second support blocks are fixed to the insulated blocking panel prior to installation of the first and second support blocks and the insulated blocking panel between the first and second I-joists.

11. The assembly as in claim 10, wherein said first and second support blocks are glued to the insulated blocking panel.

12. The assembly as in claim 1, wherein said first and second I-joists, said first and second support blocks, and said insulated blocking panel all rest on a horizontal plate, and wherein said insulated blocking panel is nailed to said horizontal plate by nails that extend at a non-vertical and a non-horizontal into the horizontal plate.

13. The assembly as in claim 1, wherein said insulating blocking panel is inflexible.

14. A floor or ceiling assembly comprising:

first and second I-joists spaced along a perimeter of a floor or ceiling and said first and second I-joists each having a length, a web, and an upper flange and a lower flange;

an insulated blocking panel extending between said first and second I-joist transverse to the lengths of said first and second I-joists, wherein said insulated blocking panel has a first and a second extension portion that extend to contact the webs of said first and said second I-joists, respectively, and wherein the insulated blocking panel has upper and lower corners surfaces near said first and second extension portions that extend along side surfaces of the upper flange and the lower flange, respectively, of the respective I-joist, and wherein the insulated blocking panel does not contact any lower surface of the upper flange of any I-joist and the insulated blocking panel does not contact any upper surface of the lower flange of any I-joist;

wherein said insulated blocking panel comprises at least one insulating layer and at least one structural layer attached to the at least one insulating layer, wherein the at least one structural layer is rigid and vertically-load-bearing and the at least one insulating layer extends substantially all the way between the upper flange side surfaces of the first and second I-joists, substantially all the way between the lower flange sides surfaces of the first and second I-joists, and substantially all the way between the webs of the first and second I-joists.

15. The assembly as in claim 14, wherein said insulated blocking panel is inflexible.

16. The assembly as in claim 15, wherein said at least one structural layer is a rigid vertical panel fixed to an inner surface of the foam board.

17. The assembly as in claim 14, wherein said at least one insulating layer is a foam board.

18. The assembly as in claim 17, further comprising a rim board located at ends of the I-joists and contacting an outer surface of said foam board of the insulated blocking panel.

19. The assembly as in claim 18, wherein said rim board comprises spaced recesses receiving ends of said first I-joist and the second I-joist.

20. The assembly as in claim 14, wherein said first and second I-joists and said insulated blocking panel all rest on a horizontal plate, and wherein said insulated blocking panel is nailed to said horizontal plate by nails that extend at a non-vertical and a non-horizontal into the horizontal plate.

21. The assembly as in claim 14, wherein said first and second I-joists and said insulated blocking panel all rest on a pony-wall near a concrete foundation wall, and wherein said insulated blocking panel is nailed to said pony-wall by nails that extend at a non-vertical and a non-horizontal into the pony-wall.

* * * * *